US005169742A

United States Patent [19]

Takahashi et al.

[11] Patent Number: 5,169,742

[45] Date of Patent: * Dec. 8, 1992

[54] SILVER HALIDE COLOR PHOTOGRAPHIC MATERIAL AND A METHOD FOR FORMING A COLOR IMAGE

[75] Inventors: Osamu Takahashi; Junichi Yamanouchi, both of Minami-ashigara, Japan

[73] Assignee: Fuji Photo Film Co., Ltd., Kanagawa, Japan

[ * ] Notice: The portion of the term of this patent subsequent to Jun. 4, 2008 has been disclaimed.

[21] Appl. No.: 606,858

[22] Filed: Oct. 31, 1990

[30] Foreign Application Priority Data

Nov. 7, 1989 [JP] Japan ..... 1-289308

[51] Int. Cl.[5] ..... G03C 7/32; G03C 7/30; G03C 7/18

[52] U.S. Cl. ..... 430/372; 430/505; 430/551

[58] Field of Search ..... 430/551, 372, 214, 505

[56] References Cited

U.S. PATENT DOCUMENTS

| | | | |
|---|---|---|---|
| 4,179,293 | 12/1979 | Hirano et al. | 430/551 |
| 4,352,873 | 10/1982 | Toda et al. | 430/551 |
| 4,358,534 | 11/1982 | Sasaki et al. | 430/551 |
| 4,774,166 | 9/1988 | Sasaki et al. | 430/376 |
| 4,939,072 | 7/1990 | Morigaki et al. | 430/551 |
| 5,021,328 | 6/1991 | Takahashi | 430/551 |

FOREIGN PATENT DOCUMENTS

| | | |
|---|---|---|
| 0125522 | 1/1986 | European Pat. Off. . |
| 0280238 | 8/1988 | European Pat. Off. . |
| 0320821 | 6/1989 | European Pat. Off. . |

*Primary Examiner*—Richard L. Schilling

*Attorney, Agent, or Firm*—Birch, Stewart, Kolasch & Birch

[57] ABSTRACT

The present invention relates to a silver halide color photographic material which comprises on a base at least one silver halide emulsion layer that is made up of at least one coupler and silver halide grains of high silver-chloride and at least one-non-photosensitive layer containing at least one oil-soluble color-mixing inhibitor and at least a homopolymer or copolymer represented by formula (I), with or without one of the substantially non-diffusible oil-soluble compounds represented by formula (II) or (III), and a method for forming an image by developing said silver halide color photographic material. The disclosure as described provides a color photographic material and a method for forming an image that is excellent in image quality and in color separation and has less mixing of colors.

19 Claims, No Drawings

SILVER HALIDE COLOR PHOTOGRAPHIC MATERIAL AND A METHOD FOR FORMING A COLOR IMAGE

FIELD OF THE INVENTION

The present invention relates to a silver halide color photographic material and a method of forming a color image that can be processed rapidly and that can give high image quality, has a reduced amount of mixing of colors and is excellent in color separation.

BACKGROUND OF THE INVENTION

In recent years, a silver halide photographic material that can give high image quality and that can be processed rapidly has been desired in this field.

In development processing of silver halide photographic materials, generally silver halide photographic materials are continuously processed by automatic processors installed in respective photofinishing laboratories. As one of their services for customers it is required that the silver halide photographic material be developed and returned to the customer on the same day that the silver halide photographic material is brought to the laboratory. Recently it is even required that the silver halide photographic material be developed and returned to the customer within one hour after receipt of the silver halide photographic material. Thus, rapid processing is increasingly required. Development of rapid processing is earnestly needed because the shortening of the processing time leads to an improvement in production efficiency and makes it possible to lower the cost.

Under these circumstances, it is known that the shape, the size, and the composition of silver halide grains in silver halide emulsions used in photographic materials greatly affects the developing speed, etc., and that the halogen composition greatly affects the developing speed, etc. It is known that when a high-chloride silver halide is used, particularly remarkably high developing speed is exhibited.

With a view to lowering the load of solution-preparation work of color developers and for protecting the environment, in recent years it has been desired that a color developer be free from benzyl alcohol. It is also desired that a color developer does not contain a sulfite, which is used as an antioxidant of color-developing agents in color developers. Sulfites react with couplers competing with the oxidized product of the color-developing agent, thereby lowering the image density, or the color-formed dye density fluctuates correspondingly to a change in the amount of the sulfite in the color developer due to the reaction.

Taking the above into consideration, recently in the field of color paper, high-chloride silver halides are used, and methods have been put into practice wherein they are processed with a color developer substantially free from both benzyl alcohol and a sulfite.

However, the use of high-chloride silver halides has had a problem that mixing of colors is liable to occur. It is presumed that one of the causes is that since the silver-developing speed becomes extremely high, in comparison with slow silver development, the oxidized product of a developing agent resulting from the silver development cannot react with the coupler in the pertinent layer, and the extent of the diffusion of that oxidized product into other layers increases relatively. Also it was revealed that the occurrence of this phenomenon is particularly facilitated when a color developer free from benzyl alcohol or a sulfite or a pyrazoloazole coupler is used.

As a means of solving this problem, it was considered to increase the thickness of the intermediate layer between the emulsion layers or to increase the quantity of a color-mixing inhibitor, such as a hydroquinone derivative, that would undergo a redox reaction with the oxidized product of a developing agent. However, but this means was attended with the problem that the amount of a color-mixing inhibitor was needed to be considerably increased in order to improve the color mixing to a satisfactory level, which was expensive, or that the rapidness of the processability was reduced owing to the increase in the thickness of the film.

SUMMARY OF THE INVENTION

Taking the above into consideration the present invention has been made. The first object of the present invention is to provide a silver halide photographic material suitable for rapid processing.

The second object of the present invention is to provide a silver halide photographic material having a reduced amount of mixing of colors and which is excellent in color separation and color reproduction, even when processed rapidly.

The third object of the present invention is to provide a method for forming a color image that can give a color photograph having less mixing of colors and excellent in color separation and color reproduction.

Other and further objects, features and advantages of the invention will appear more evident from the following description.

DETAILED DESCRIPTION OF THE INVENTION

The inventors have found that when an oil-soluble color-mixing inhibitor that will undergo a redox reaction with the oxidized product of a developing agent is used in combination with a sulfinic acid-containing polymer, the color-mixing-inhibiting effect is increased synergistically, and when a color-mixing-inhibition booster, described below, is used in addition thereto, the color-inhibiting effect is greatly increased further, leading to the present invention.

The above objects have been attained effectively by providing a color photographic material and a color-image forming method described below.

(1) A silver halide color photographic material comprising on a base at least one silver halide emulsion layer containing at least one coupler that can form a dye by the coupling reaction with the oxidized product of an aromatic primary amine developing agent and silver chloride or silver chlorobromide comprising 90 mol% or more of silver chloride and that is substantially free from silver iodide, and at least one non-photosensitive layer containing at least one oil-soluble color-mixing inhibitor that can undergo a redox reaction with the oxidized product of said developing agent, and at least one compound represented by the following formula (I):

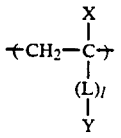

Formula (I)

wherein X represents a hydrogen atom or a lower alkyl group or an aralkyl group, L represents a bivalent linking group, Y represents a sulfinic acid group or a sulfinic acid group forming a salt, and l represents 0 or 1.

(2) A color photographic material stated under (1), wherein in that said non-photosensitive layer further contains at least one substantially non-diffusible oil-soluble compounds represented by the following formulae (II) and (III):

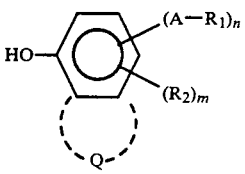

Formula (II)

wherein A represents a bivalent electron-attractive group, $R_1$ represents an aliphatic group, an aryl group, an alkoxy group, an aryloxy group, an alkylamino group, an anilino group, a heterocyclic amino group, or a heterocyclic group, n is 1 or 2, $R_2$ represents an aliphatic group, an alkoxy group, a hydroxyl group, or halogen, m is an integer of 0 to 4, and to the phenol ring may be fused a benzene ring or a heterocyclic group formed at Q, $HO—R_3$ Formula (III)

wherein $R_3$ represents an aliphatic group having 12 or more carbon atoms in all.

(3) A silver halide color photographic material stated under any one of (1) and (2), wherein said coupler is a pyrazoloazole coupler.

(4) A color-image forming method, wherein after a silver halide color photographic material stated under (1), (2), or (3) is exposed image-wise, the silver halide color photographic material is processed with a color developer substantially free from benzyl alcohol and sulfite ions.

Sulfinic acid-containing polymers having repeating units represented by formula (I) will now be described in detail.

X in formula (I) represents a hydrogen atom or a lower alkyl group having 1 to 4 carbon atoms or an aralkyl group having 7 to 20 carbon atoms, and preferably represents a hydrogen atom or a methyl group.

L represents a bivalent linking group having 1 to 20 carbon atoms, for example, an aliphatic group, or an aromatic group, or a linking group formed by combining one of these with $—CO_2$ or —CONH—, and more specifically L preferably represents for example

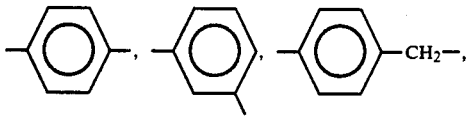

-continued

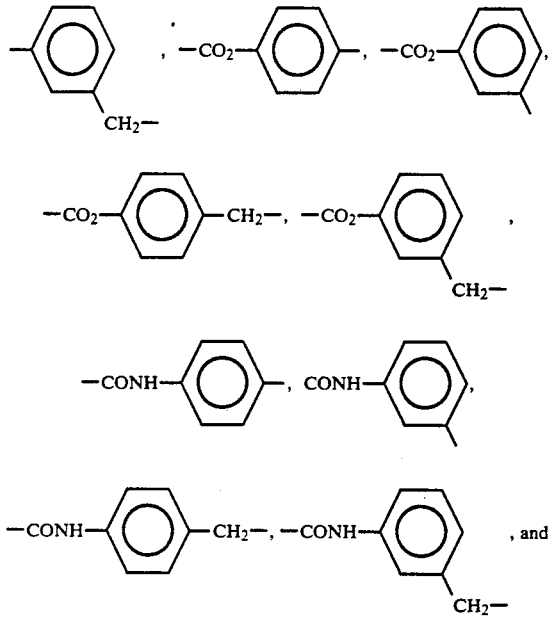

$—CO_2CH_2CH=CHCH_2—$, or $—CONHCH_2CH=CHCH_2—$.

Y represents a sulfinic acid group or a sulfinic acid group forming a base. Preferably, the cation that forms the sulfinate is a monovalent to trivalent one. If the cation is a divalent or trivalent one, the anion corresponding to the cation may include anions other than monomer units represented by formula (I). Preferable cations are an ammonium ion and metal ions, with particular preference given to alkali ions (e.g., a sodium ion and potassium ion).

Preferable specific examples of the repeating units represents by the above formula are:

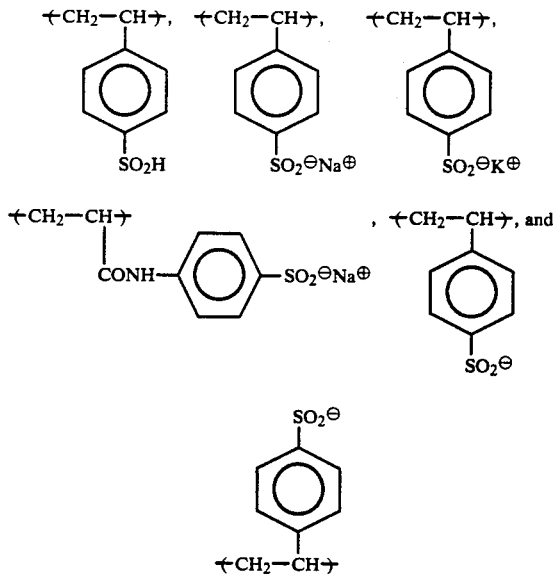

The sulfinic acid-containing polymer used in the present invention may be synthesized by using two or more ethylenically unsaturated monomers having at least one sulfinic acid group.

In the synthesis, an ethylenically unsaturated monomer having a sulfinic acid group and an ethylenically unsaturated monomer having no sulfinic acid group may be used together.

Specific examples of the ethylenically unsaturated monomer that can be used additionally in this way are ethylene, propylene, 1-butene, isobutene, styrene, α-methylstyrene, vinylketones, monoethylenically unsaturated esters of aliphatic acids (e.g., vinyl acetate and ally acetate), esters or amides (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate, acrylamide, and N-methyl acrylamide) of ethylenically unsaturated monocarboxylic acids or dicarboxylic acids (e.g., acrylic acid, methacrylic acid, and itaconic acid), monoethylenically unsaturated compounds (e.g., acrylonitrile), and dienes (e.g., butadiene and isoprene).

Although the ethylenically unsaturated monomer having no sulfinic acid group can be added in any amount as required, preferably it is added in an amount of 0 to 1000 mol% and particularly preferably 0 to 200 mol% based on the monomer having a sulfinic acid group.

When the present sulfinic acid-containing polymer is synthesized in the form of a latex and is added as it is, it is preferable that the polymer is a copolymer obtained by using a monomer having at least two copolymerizable ethylenically unsaturated groups.

Examples of such a monomer include, for example, divinylbenzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacrylate, and tetramethylene diacrylate and, of these, divinylbenzene and ethylene glycol dimethacrylate are particularly preferable.

The amount of such a monomer having two or more ethylenically unsaturated groups to be used is preferably 0 to 60 mol%, and particularly preferably 0 to 30 mol% of all the monomer components in the present sulfinic acid-containing polymer.

The molecular weight of the sulfinic acid-containing polymer to be used in the present invention is suitably 5,000 to 1000,000, and preferably 10,000 to 100,000.

Specific examples of the sulfinic acid-containing polymer to be used in the present invention are shown below, but the present invention is not limited to them (the ratio of each monomer unit indicates the molar percentage).

I-1

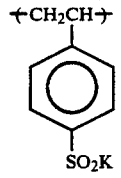

I-2

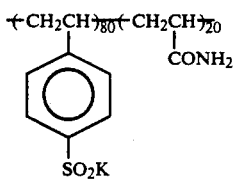

-continued

I-3

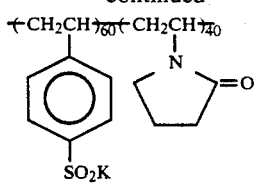

I-4

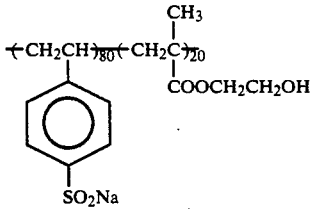

I-5

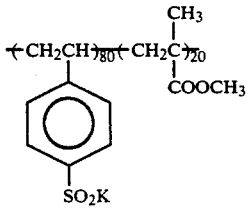

I-6

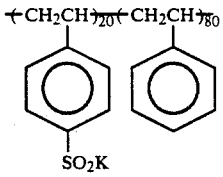

I-7

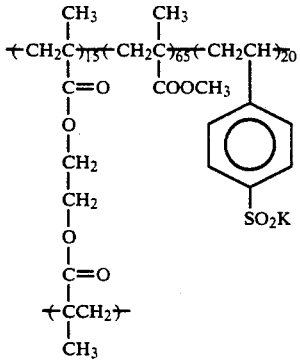

I-8

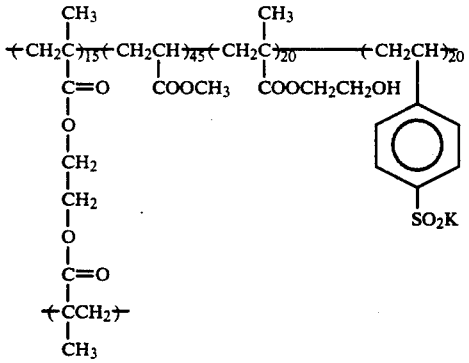

The synthesis of the above polymers may be carried out by generally well known radical polymerization processes (for example, details are shown by Takayuki Otsu and Masaetsu Kinoshita in "Kobunshi Gosei-no Jikkenho,"Kagakudojin, 1972, pages 124 to 154) and particularly preferably the solution polymerization process or the emulsion polymerization process is used.

The sulfinic acid-containing polymer represented by formula (I) of the present invention may be added to a non-photosensitive layer by dissolving the sulfinic acid-containing polymer in water or a water-miscible organic solvent, such as methanol. If the compound of the present invention is soluble in oils, the compound may be added by the oil-in-water dispersion process known as the oil-protect process. As the non-photosensitive layer mentioned above, an intermediate layer that will be provided between photosensitive layers and a layer that will be provided between a photosensitive layer and a protective layer (e.g., an ultraviolet absorber-containing layer) can be exemplified. Although the amount of the sulfinic acid-containing compound represented by formula (I) of the present invention to be used may be varied within a wide range, it is preferable that the amount per non-photosensitive layer will be generally 5 to 300 mg/m$^2$, and more preferably 7 to 200 mg/m$^2$.

The color-mixing inhibition boosters represented by formulae (II) and (III) will now be described below in more detail.

In formula (II), A preferably represents a bivalent electron attractive group represented by

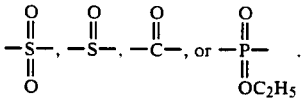

In formulae (II) and (III), the aliphatic group represented by $R_1$, $R_2$ or $R_3$ includes substituted or unsubstituted straight-chain or branched alkyl, aralkyl, alkenyl, alkynyl, cycloalkyl, and cycloalkenyl groups. The aryl group includes substituted and unsubstituted aryl groups such as phenyl, 4-t-butylphenyl, 2,4-di-t-amylphenyl, and naphtyl. The alkoxy group includes substituted and unsubstituted alkoxy groups such as methoxy, ethoxy, benzyloxy, heterodecyloxy, and octadecyloxy. The aryloxy group includes substituted and unsubstituted aryloxy groups such as phenoxy, 2-methylphenoxy, and naphthoxy. The alkylamino group includes substituted and unsubstituted alkylamino groups such as methylamino, butylamino, and octylamino. The anilino group includes phenylamino, 2-chloroanilino, 3-dodecyloxycarbonylanilino.

As specific examples of the heterocyclic group, pyrazolyl, imidazolyl, triazolyl, pyridyl, quinolyl, piperidyl, and triazinyl can be mentioned, which may be applied to the heterocyclic moiety of the heterocyclic amino group.

The halogen atom includes for example chlorine, bromine, and fluorine.

Specific examples of substituents of the substituted alkyl group, the substituted aryl group, the substituted alkoxy group, the substituted aryloxy group, the substituted alkylamino group, the substituted anilino group, the substituted heterocyclic amino group, and the substituted heterocyclic group represented by $R_1$, $R_2$ and $R_3$ are a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, and an aryloxycarbonyl group.

The oil-soluble compound of formula (II) has preferably 10 or more carbon atoms in the molecule in all.

Specific examples of the oil-soluble color mixing inhibition promotors represented by formulae (II) and (III) of the present invention are given below, but the compounds of the present invention are not limited by them.

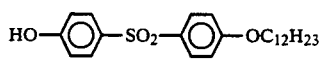
(II-1)

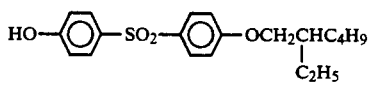
(II-2)

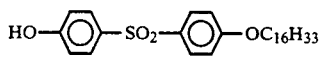
(II-3)

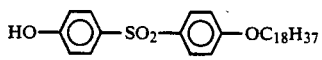
(II-4)

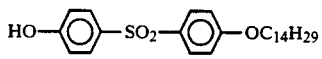
(II-5)

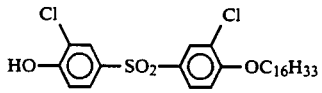
(II-6)

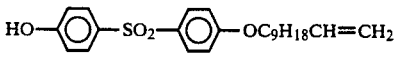
(II-7)

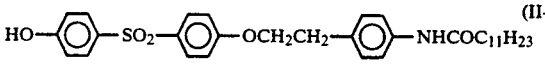
(II-8)

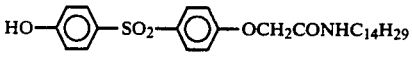
(II-9)

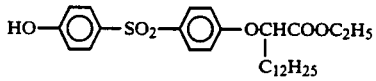
(II-10)

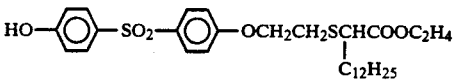
(II-11)

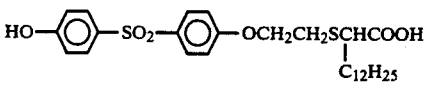
(II-12)

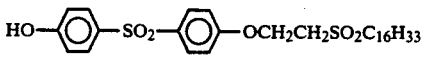
(II-13)

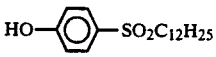
(II-14)

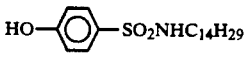
(II-15)

-continued
(II-16)
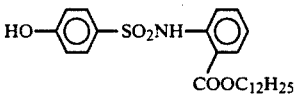
(II-17)
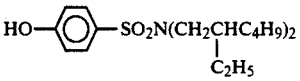
(II-18)
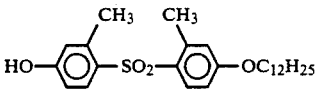
(II-19)
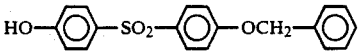
(II-20)
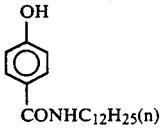
(II-21)
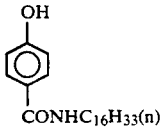
(II-22)
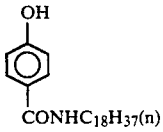
(II-23)
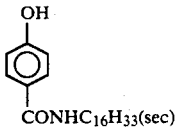
(II-24)
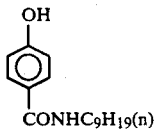
(II-25)
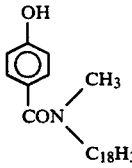
(II-26)
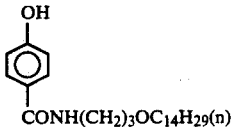
(II-27)
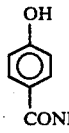
-continued
(II-28)
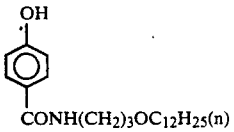
(II-29)
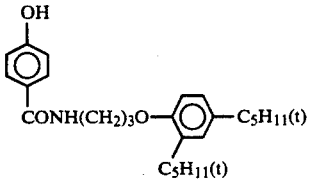
(II-30)
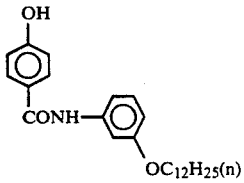
(II-31)
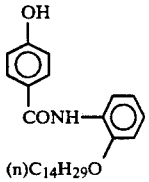
(II-32)
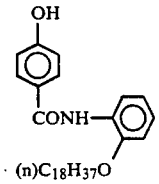
(II-33)
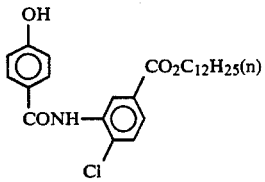
(II-34)
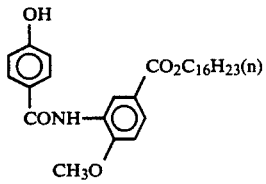
(II-35)
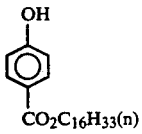
(II-36)
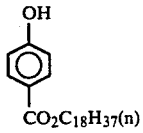

-continued
(II-37)
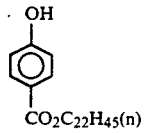
(II-38)
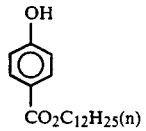
(II-39)
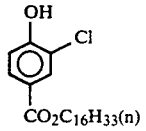
(II-40)
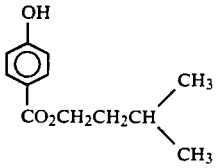
(II-41)
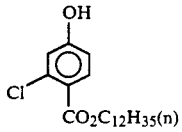
(II-42)
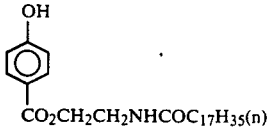
(II-43)
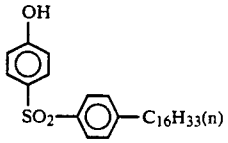
(II-44)
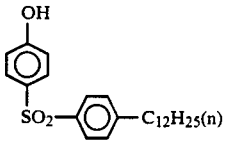
(II-45)
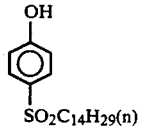
(II-46)
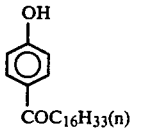
(II-47)
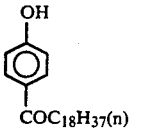
-continued
(II-48)
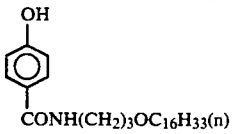
(II-49)
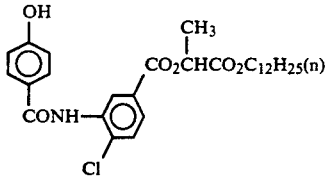
(II-50)
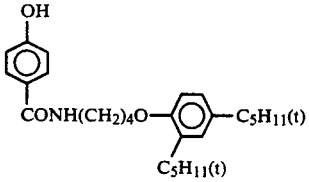
(II-51)
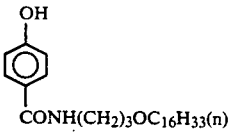
(II-52)
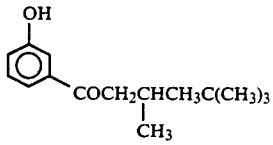
(II-53)
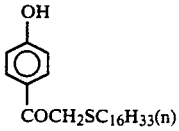
(II-54)
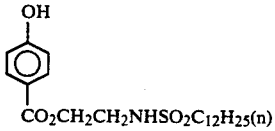
(II-55)
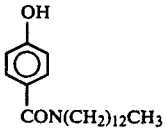
(II-56)
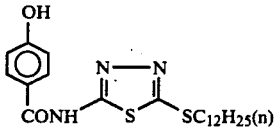
$CH_3(CH_2)_{10}CH_2OH$ (III-1)
$CH_3(CH_2)_{11}CH_2OH$ (III-2)
$CH_3(CH_2)_{12}CH_2OH$ (III-3)
$CH_3(CH_2)_{13}CH_2OH$ (III-4)
$CH_3(CH_2)_{14}CH_2OH$ (III-5)
$CH_3(CH_2)_{15}CH_2OH$ (III-6)
$CH_3(CH_2)_{16}CH_2OH$ (III-7)

-continued $CH_3(CH_2)_{17}CH_2OH$ (III-8)

$CH_3(CH_2)_{18}CH_2OH$ (III-9)

(III-10)

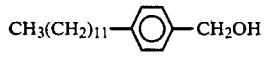

(III-11)

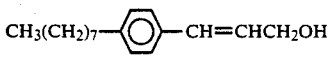

$C_{10}H_{21}O(CH_2)_5O(CH_2)_2OH$ (III-12)

(III-13)

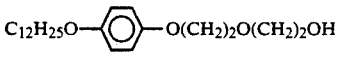

(III-14)

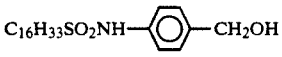

(III-15)

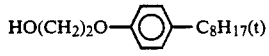

In order to add the color-mixing inhibition promotor of the present invention to the non-photosensitive layer, generally it is added by the oil-in-water dispersion process known as the oil-protect process. Particularly preferably, a color-mixing inhibitor and a color-mixing-inhibition promotor of the present invention are dissolved in a solvent and the solution is dispersed into an aqueous gelatin solution containing a surface-active agent, thereby co-emulsifying them. Alternatively, to the solution prepared in the above manner may be added water or an aqueous gelatin solution to produce an oil-in-water dispersion by phase inversion. If the color-mixing inhibitor is an oil and also serves as a solvent, the solvent mentioned above may not be used. The particle diameter of the oil droplets is suitably 0.04 to 0.35 μm, preferably 0.04 to 0.25 μm, and more preferably 0.04 to 0.20 μm, on the average.

Although the amount of the color-mixing-inhibition promotor of the present invention to be used will vary within a wide range depending on the type and the amount of the color-mixing inhibitor, the weight ratio of the color-mixing-inhibition promotor/color-mixing inhibitor is preferably from 0.05 to 2, and more preferably from 0.1 to 1. The amount of the color mixing inhibitor is preferably 7 to 400 mg/m$^2$, and more preferably 10 to 240 mg/m$^2$.

The non-photosensitive layer (color-mixing-inhibiting layer) containing the color-mixing inhibitor, the sulfinic acid-containing polymer, and the color-mixing-inhibition promotor is, for example, an intermediate layer provided between photosensitive layers, or a layer (e.g., a layer containing an ultraviolet absorber) provided between a photosensitive layer and a protective layer.

As the oil-soluble color-mixing inhibitor that can be used in the present invention, various reducing agents, such as hydroquinones, can be mentioned. The most typical ones are alkylhydroquinones, and to use them as a color-mixing inhibitor in an intermediate layer, for example, U.S. Pat. Nos. 2,360,290, 2,419,613, 2,403,721, 3,960,570, and 3,700,453 and JP-A Nos. 106329/1974 and 156438/1975 describe monoalkyl-substituted, and for example, U.S. Pat. Nos. 2,728,659, 2,732,300, 3,243,294, and 3,700,453 and JP-A Nos. 156438/1975, 9528/1978, 55121/1978, 29637/1979, and 55339/1985 describe dialkyl-substituted, hydroquinones.

Alkylhydroquinones preferably used as the color-mixing inhibitor of the present invention are those represented by the following formula (HQ-1):

Formula (HQ-1)

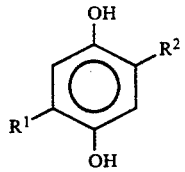

wherein $R^1$ and $R^2$ each represent a hydrogen atom or a substituted or unsubstituted alkyl group having 1 to 20 carbon atoms (e.g., methyl, t-butyl, n-octyl, sec-octyl, t-octyl, sec-dodecyl, t-pentadecyl, and sec-octadecyl), and one of $R^1$ and $R^2$ is an alkyl group.

Hydroquinone sulfonates can also be used preferably as a color-mixing inhibitor as described, for example, in JP-A No. 172,040/1985.

The hydroquinone sulfonates preferably used as a color-mixing inhibitor of the present invention are those represented by the following formula (HQ-2):

Formula (HQ-2)

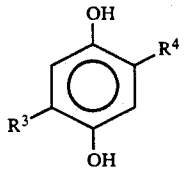

wherein $R^3$ represents a substituted or unsubstituted alkyl, alkylthio, amido, or alkyloxy group, and $R^4$ represents a sulfo group or a sulfoalkyl group (e.g., sulfopropyl).

Amidohydroquinones can also be used preferably as a color-mixing inhibitor. For example, JP-A Nos. 202465/1984, 103638/1987, and 150346/1987 describe them. Amidohydroquinones preferably used as a color-mixing inhibitor in the present invention are those having the following formula (RD-1):

Formula (RD-1)

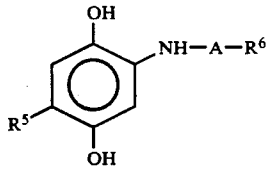

wherein $R^5$ represents a hydrogen atom, a halogen atom, or a substituted or unsubstituted alkyl group, A represents $$-\overset{O}{\overset{\|}{C}}- \quad \text{or} \quad -SO_2-,$$

and $R^6$ represents a substituted or unsubstituted alkyl or aryl group.

In addition to the above alkylhydroquinones, hydroquinone sulfonates, and amidohydroquinones, hydroquinones having an electron-attractive substituent described, for example, in JP-A Nos. 43521/1980, 109344/1981, and 22237/1982, can also be used preferably as a color-mixing inhibitor. Specific examples of hydroquinones preferable as a color mixing inhibitor are given below.
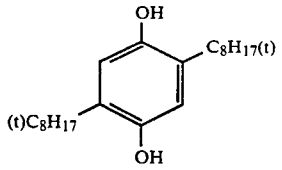
(HQ-1)
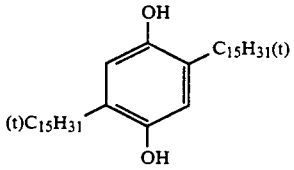
(HQ-2)
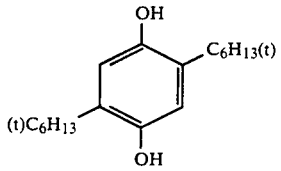
(HQ-3)
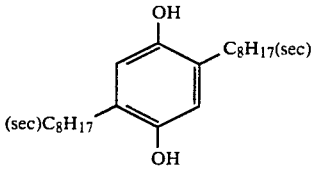
(HQ-4)
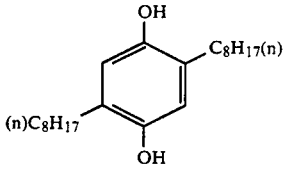
(HQ-5)
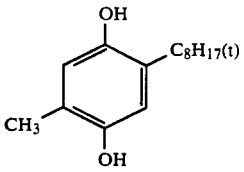
(HQ-6)
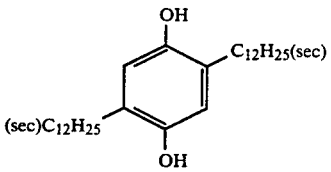
(HQ-7)
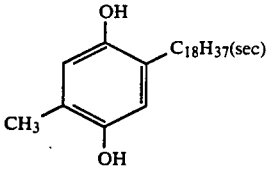
(HQ-8)
-continued
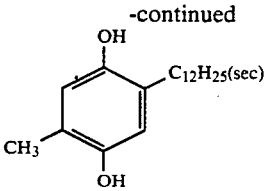
(HQ-9)
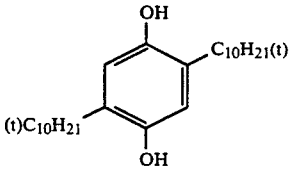
(HQ-10)
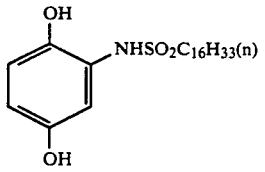
(HQ-11)
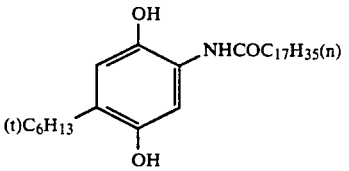
(HQ-12)
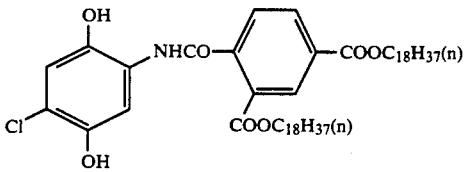
(HQ-13)
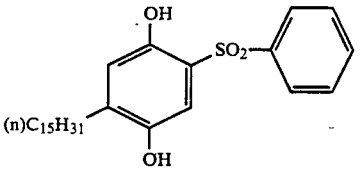
(HQ-14)
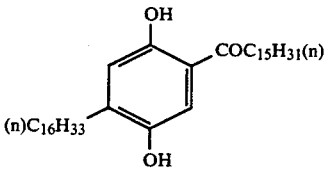
(HQ-15)
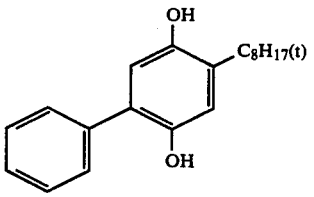
(HQ-16)
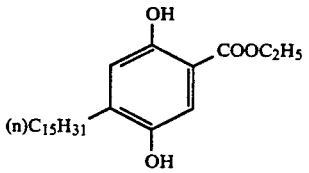
(HQ-17)

-continued (HQ-18)

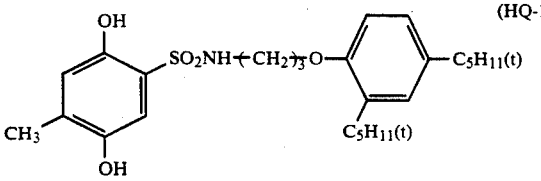

(HQ-19)

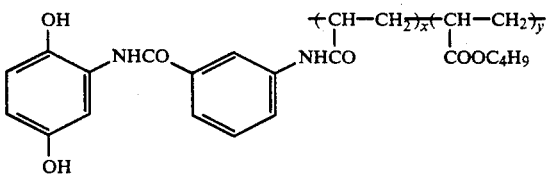

x:y = 2:5

Av. molecular weight: about 20,000

(HQ-20)

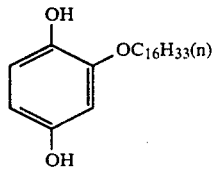

(HQ-21)

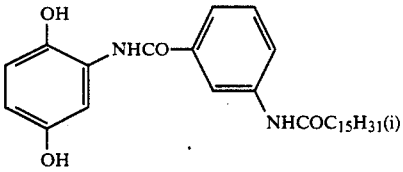

(HQ-22)

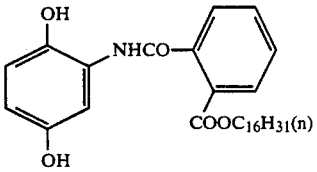

(HQ-23)

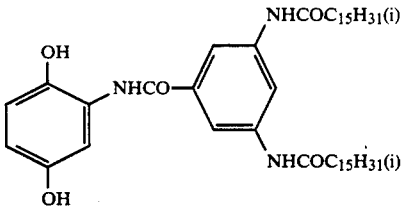

(HQ-24)

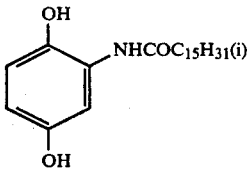

(HQ-25)

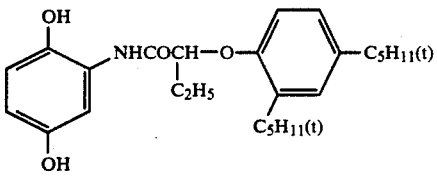

-continued (HQ-26)

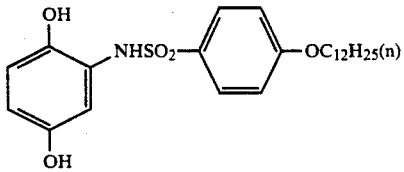

Reducing agents that have a skeleton other than that of hydroquinone may be used as a color-mix inhibitor. As examples of them, can be mentioned gallic acid amides described in, for example, JP-A No. 156933/1983, and sulfonamidophenols described in, for example, JP-A Nos. 5247/1984 and 202465/1984. Specific examples of them are shown below.

(RD-1)

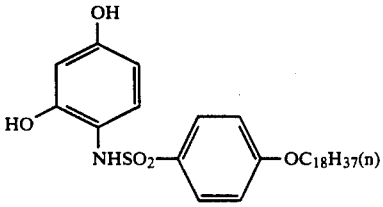

(RD-2)

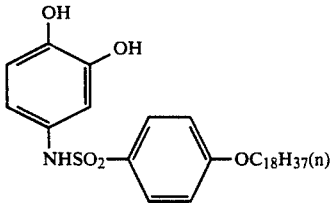

(RD-3)

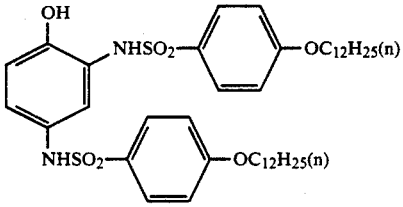

(RD-4)

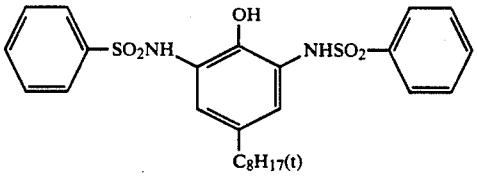

(RD-5)

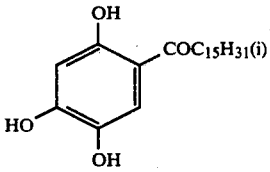

(RD-6)

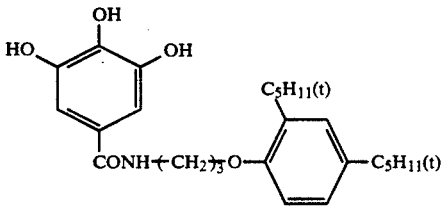

-continued (RD-7)

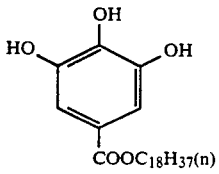

(RD-8)

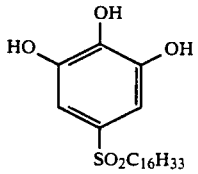

(RD-9)

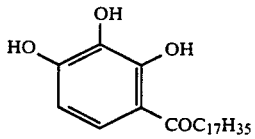

(RD-10)

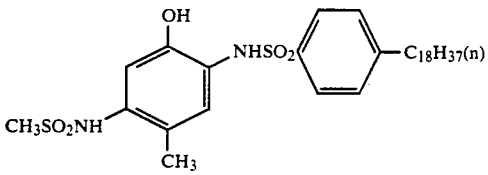

As hydroquinones useful for gradation adjustment in the silver halide emulsion layer of the present invention, hydroquinones mentioned above as a color-mixing inhibitor are preferable, and in particular, alkylhydroquinones and hydroquinone sulfonates are more preferable.

As high-boiling solvents for use to disperse photographically useful substances such as color-mixing inhibitor, color-mixing inhibition promoter and sulfininc acid containing polymers, any organic substance being compatible with oil-soluble photographically useful substance and being liquid or solid at ordinary temperature may be used, and compounds represented by the following formulae ($III_s$) to ($VII_s$) are preferable.

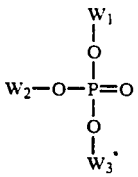

Formula ($III_s$)

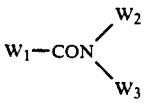

Formula ($IV_s$)

Formula ($V_s$)

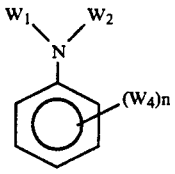

Formula ($VI_s$)

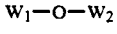

Formula ($VII_s$)

wherein $W_1$, $W_2$, and $W_3$ each represent a substituted or unsubstituted, alkyl group, cycloalkyl group, alkenyl group, aryl group, or heterocyclic group, $W_4$ represents $W_1$, O-$W_1$ or S-$W_1$, n is an integer of 1 to 5, when n is 2 or over, $W_4$ groups may be the same or different, and in formula ($VII_s$), $W_1$ and $W_2$ may together form a condensed ring.

In the present invention, the amount of high-boiling solvent to be used may change in a wide range due to the kind and the amount of color-mixing inhibitor, the ratio of high-boiling solvent to color-mixing inhibitor is preferably 0.05 : 1 to 20 : 1, and more preferably 0.1 : 1 to 10 : 1.

Of compounds represented by formulae ($III_s$) to ($VII_s$), compounds represented by formulae ($III_s$), ($IV_s$), and ($V_s$) are preferable.

Specific examples of high-boiling organic solvent are shown below, but the invention is not limited by them.

(S-1)

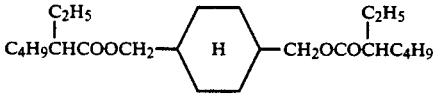

(S-2)

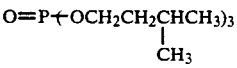

(S-3)

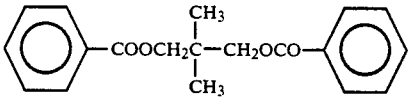

(S-4)

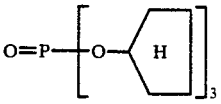

(S-5)

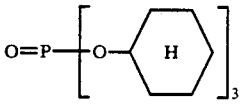

(S-6)

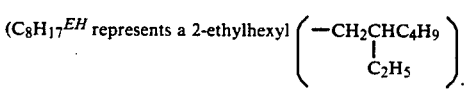

($C_8H_{17}^{EH}$ represents a 2-ethylhexyl $\left(-CH_2\underset{C_2H_5}{\underset{|}{C}}HC_4H_9\right)$.

The same shall apply hereinafter.)

(S-7)

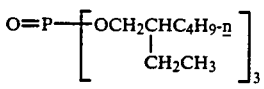

(S-8)

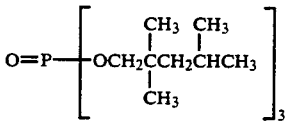

(S-9)

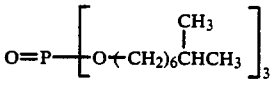

(S-10)

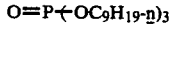

(S-11)

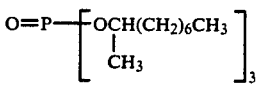

(S-12)

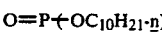

-continued
(S-13)
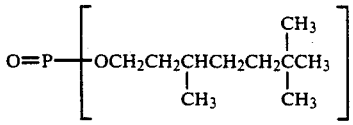
(S-14)
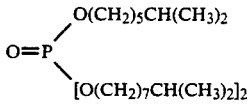
(S-15)
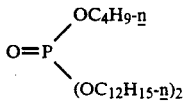
(S-16)
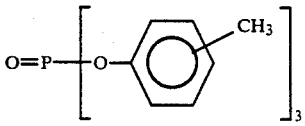
(S-17)
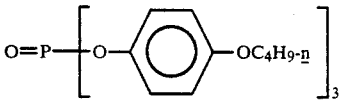
(S-18)
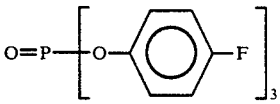
(S-19)
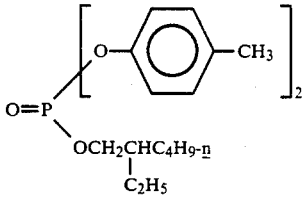
(S-20)
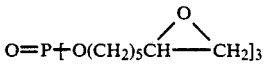
(S-21)
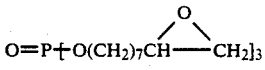
(S-22)
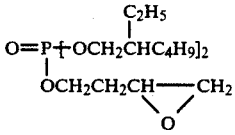
(S-23)
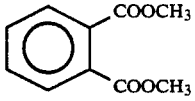
(S-24)
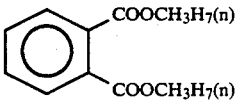
(S-25)
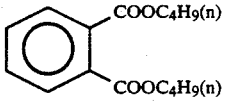
-continued
(S-26)
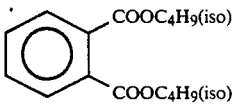
(S-27)
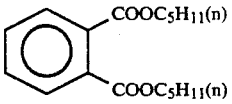
(S-28)
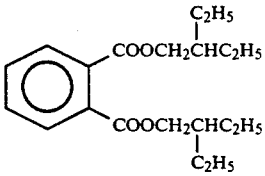
(S-29)
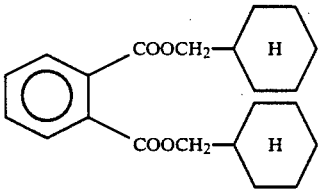
(S-30)
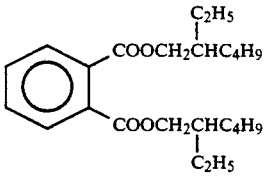
(S-31)
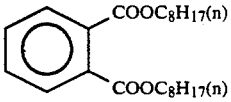
(S-32)
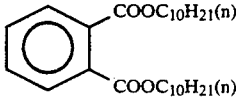
(S-33)
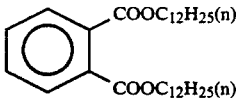
(S-34)
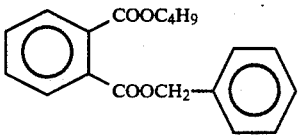
(S-35)
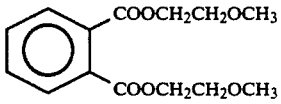
(S-36)
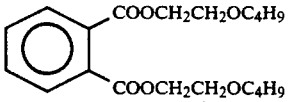

-continued
(S-37)
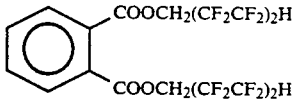
(S-38)
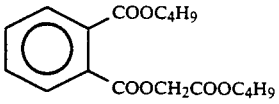
(S-39)
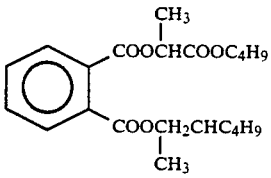
(S-40)
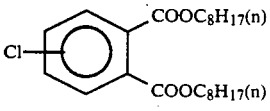
(S-41)
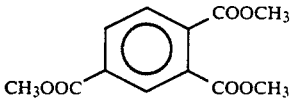
(S-42)
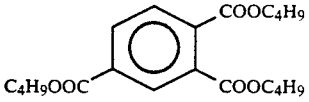
(S-43)
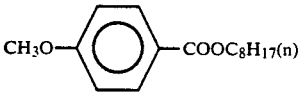
(S-44)
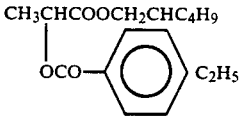
(S-45)
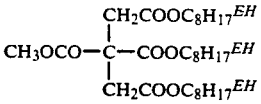
(S-46)
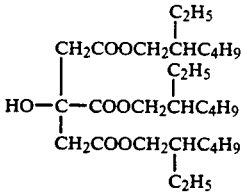
(S-47)
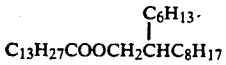
(S-48)
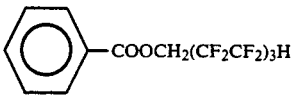
(S-49)
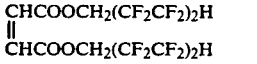
-continued
(S-50)
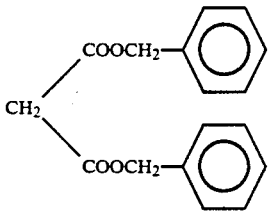
(S-51)
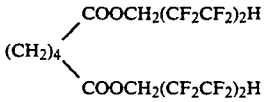
(S-52)
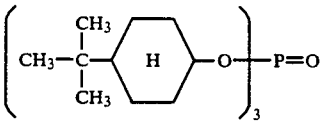
(S-53)
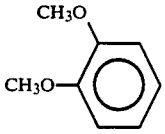
(S-54)
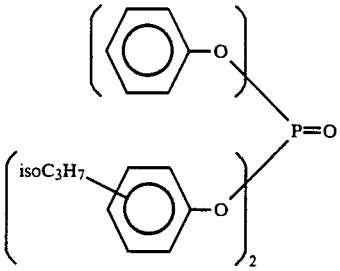
(S-55)
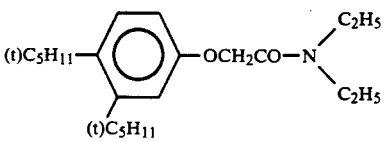
(S-56)
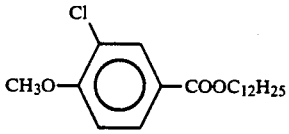
(S-57)
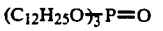
(S-58)
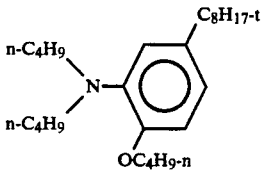
(S-59)
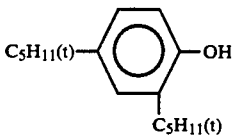

-continued (S-60)

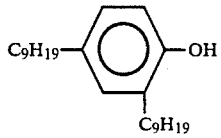

(S-61)

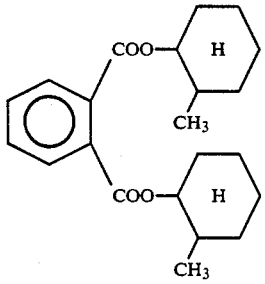

(S-62)

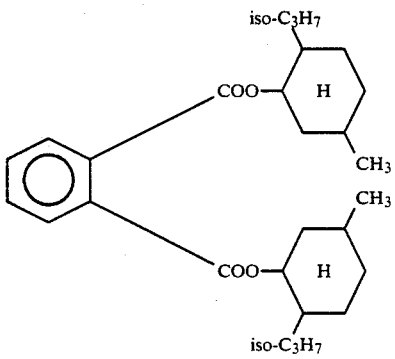

(S-63)

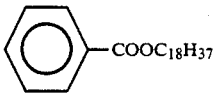

(S-64)

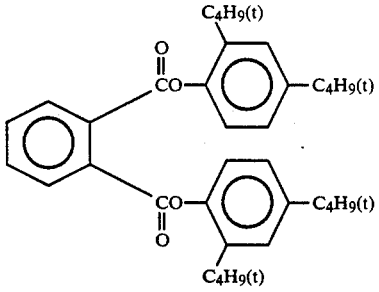

(S-65)

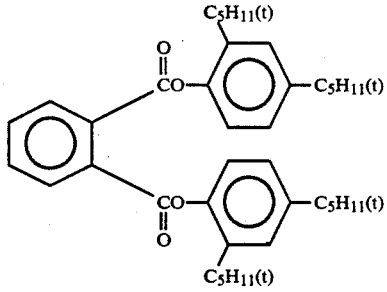

(S-66)

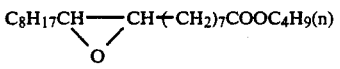

(S-67)

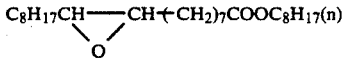

-continued (S-68)

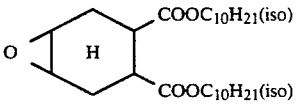

(S-69)

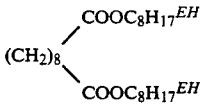

(S-70)

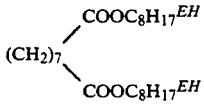

(S-71)

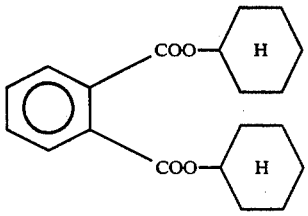

The color photographic material of the present invention can be constituted by applying at least each a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

In the present invention, the coating amount of silver halide is 1.5 g/m$^2$ or less, preferably 0.8 g/m$^2$ or less and 0.2 g/m$^2$ or more, in terms of silver. A coating amount of 0.8 g/m$^2$ or less is very preferable in view of rapidness, processing-stability, and storage-stability of image after processing (in particular, restraint of yellow stain). Further, the coating silver amount is preferably 0.2 g/m$^2$ or over, in view of image-density. From these points of view the coating amount of silver halide in terms of silver is more preferably 0.2 to 0.75 g/m$^2$, particularly preferably 0.2 to 0.7 g/m$^2$.

As the silver halide emulsion used in the present invention, one comprising silver chlorobromide or silver chloride of silver chloride content 90 mol% or over and being substantially free from silver iodide can be preferably used. Herein the term "substantially free from silver iodide" means that the silver iodide content is 1 mol% or below, and preferably 0.2 mol% or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

Further in the photographic material suitable for the rapid processing of an emulsion of high silver chloride content, a so-called high-silver-chloride emulsion may be preferably used. The content of silver chloride of the high-silver-chloride emulsion is preferably 90 mol% or over, more preferably 95 mol% or over.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol%, and more preferably over 20 mol%. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol% or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol%, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, *in Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-sensitive emulsion, wherein a latent image is formed mainly on the grain surface, or of a so-called internal-image emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

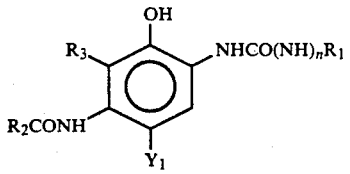

Formula (C-I)

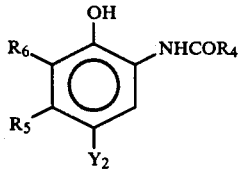

Formula (C-II)

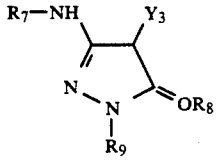

Formula (M-I)

-continued

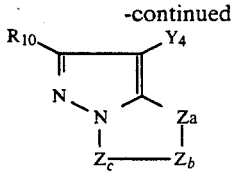

Formula (M-II)

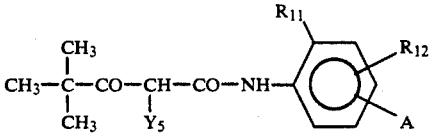

Formula (Y)

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za-Zb bond and the Zb-Zc bond is a double bond, and the other is a single bond. If the Zb-Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents —$NHCOR_{13}$, —$NHSO_2$—$R_3$, —$SO_2NHR_{13}$, —$COOR_{13}$, or $$-SO_2\underset{\underset{R_{14}}{|}}{N}-R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

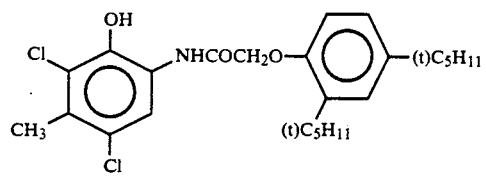

(C-1)

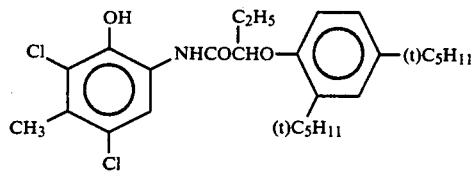

(C-2)

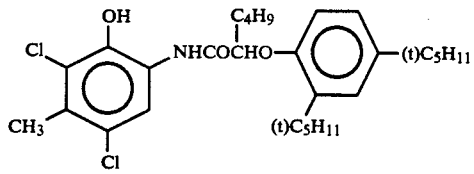

(C-3)

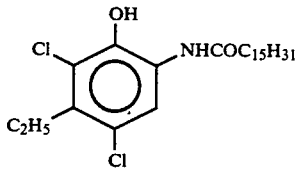

(C-4)

-continued
(C-5)
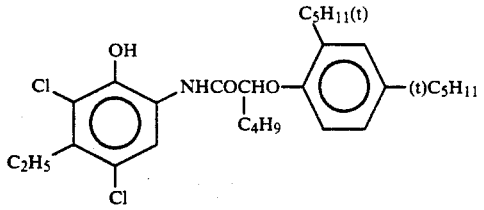
(C-6)
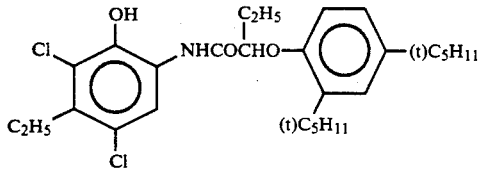
(C-7)
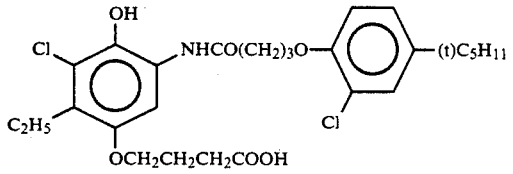
(C-8)
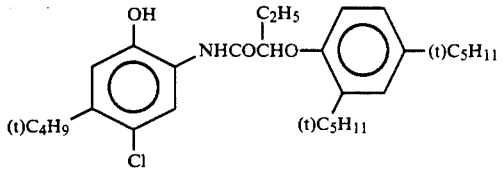
(C-9)
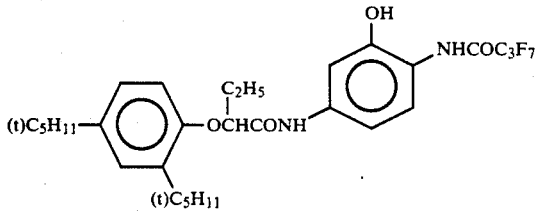
(C-10)
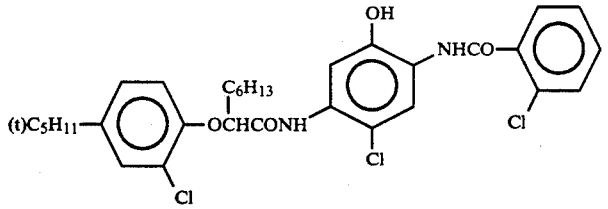
(C-11)
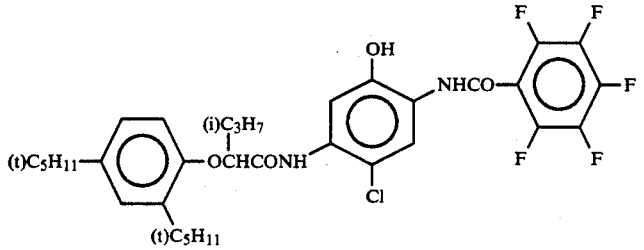

-continued
(C-12)
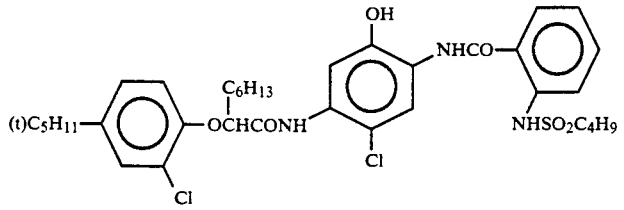
(C-13)
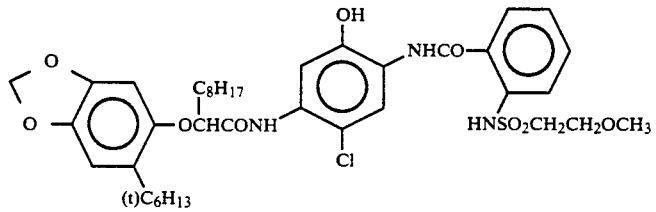
(C-14)
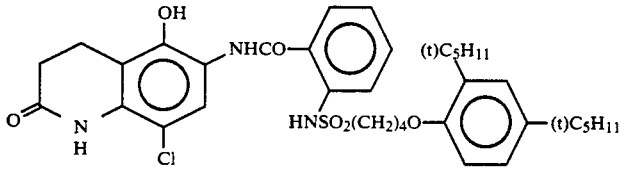
(C-15)
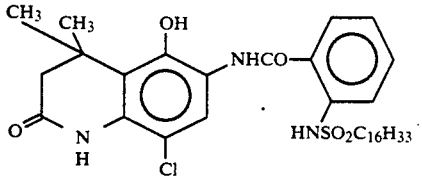
(C-16)
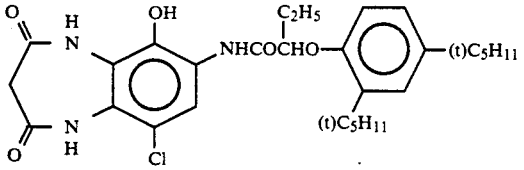
(C-17)
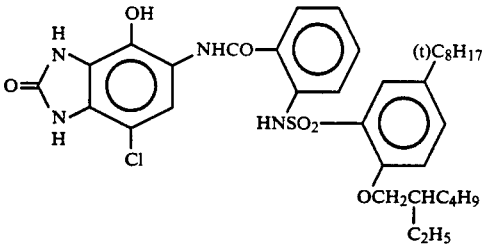
(C-18)
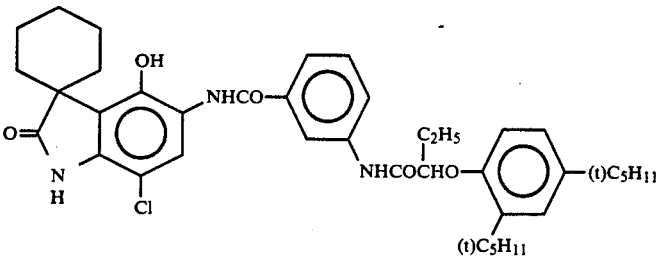

-continued
(C-19)
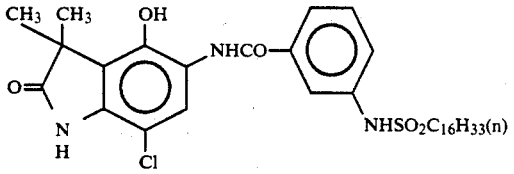
(C-20)
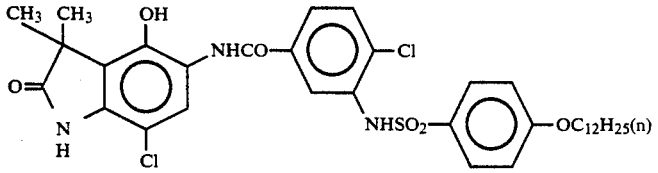
(C-21)
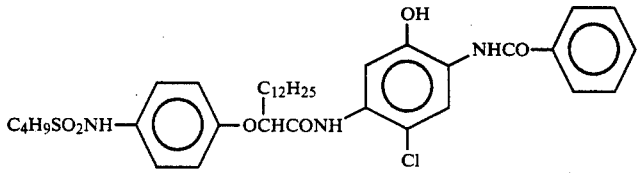
(C-22)
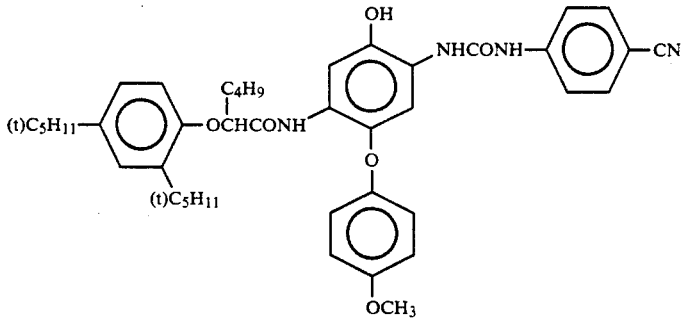
(M-1)
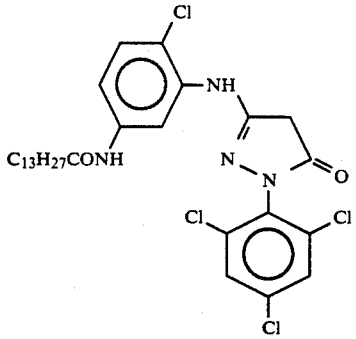
(M-2)
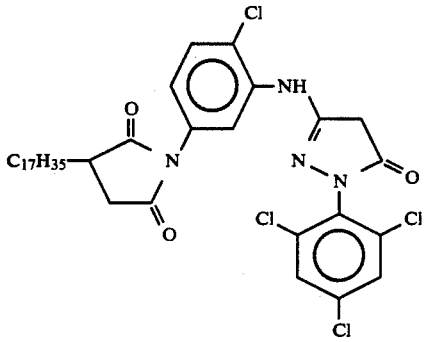

-continued
(M-3)
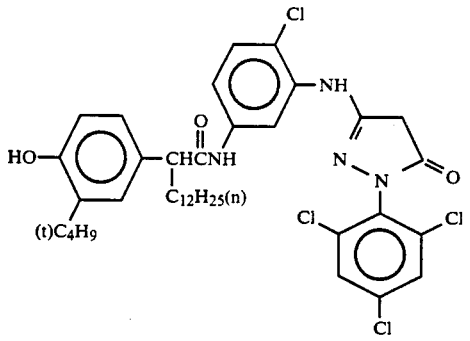
(M-4)
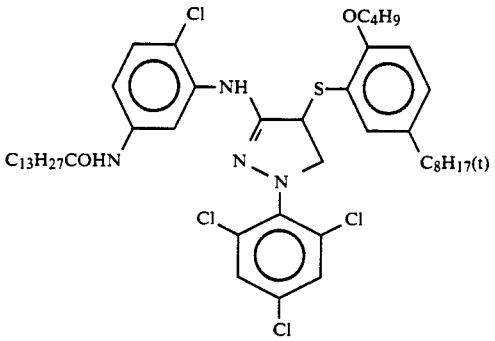
(M-5)
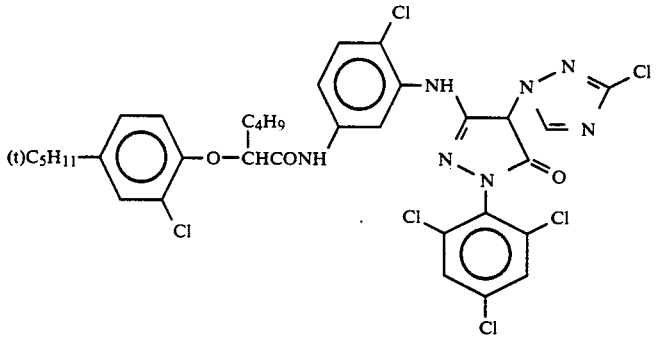
(M-6)
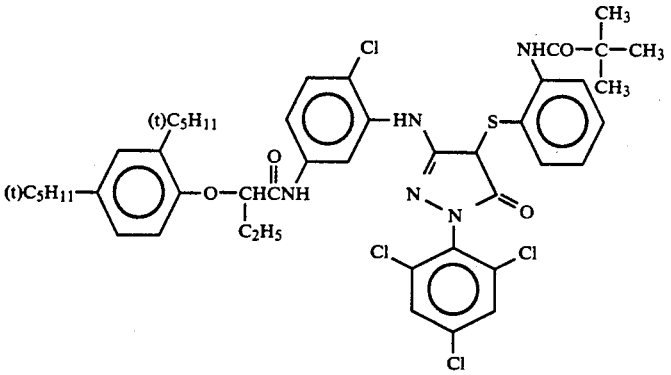

-continued
(M-7)
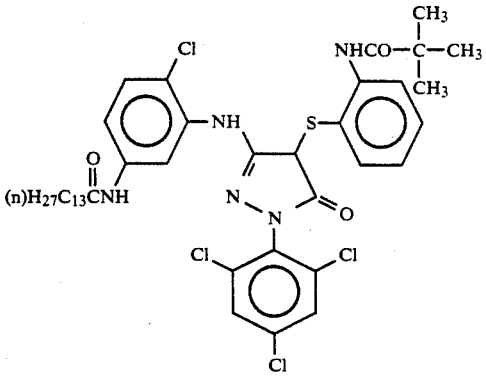
(M-8)
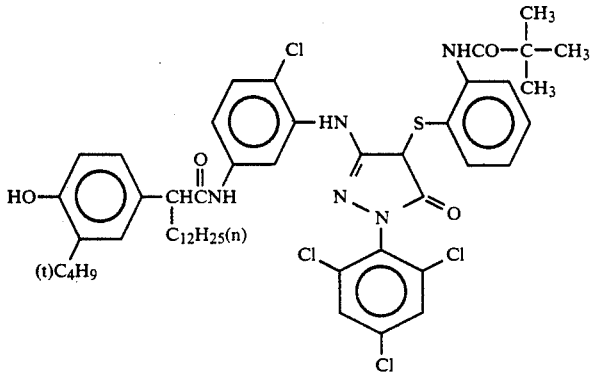
| Compound | $R_{10}$ | $R_{15}$ | $Y_4$ |
|---|---|---|---|
| | | 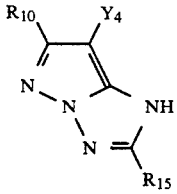 | |
| M-9 | $CH_3$— | 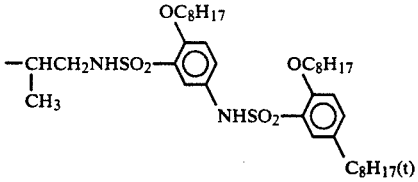 | Cl |
| M-10 | The same as the above | 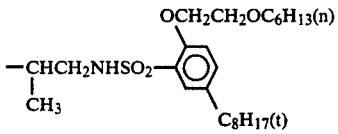 | The same as the above |
| M-11 | $(CH_3)_3C$— | 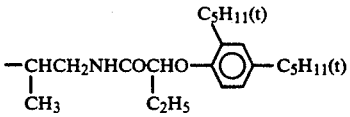 | 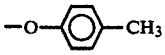 |
| M-12 | 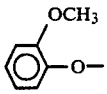 | 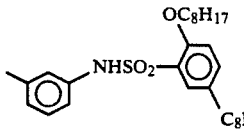 | 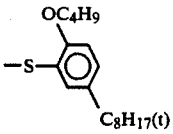 |

-continued
| Compound | $R_{10}$ | $R_{15}$ | $Y_4$ |
|---|---|---|---|
| M-13 | $CH_3$— | 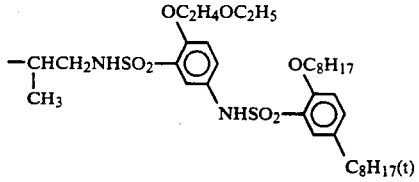 | Cl |
| M-14 | The same as the above | 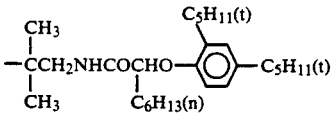 | The same as the above |
| M-15 | The same as the above | 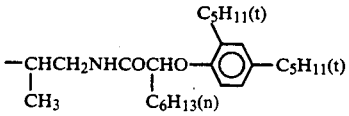 | The same as the above |
| M-16 | The same as the above | 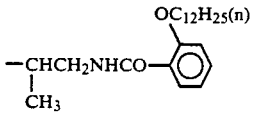 | The same as the above |
| M-17 | The same as the above | 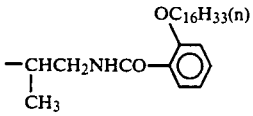 | The same as the above |
| M-18 | 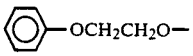 | 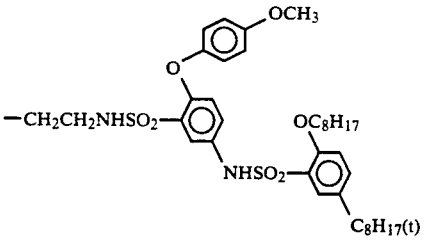 | 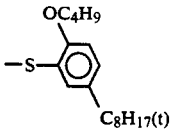 |
| M-19 | $CH_3CH_2O$— | The same as the above | The same as the above |
| M-20 | 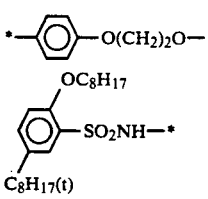 | 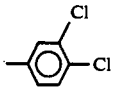 | 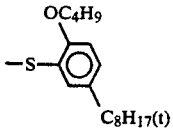 |
| M-21 | 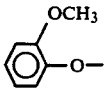 | 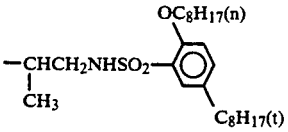 | Cl |
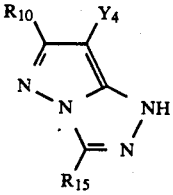

-continued
| Compound | $R_{10}$ | $R_{15}$ | $Y_4$ |
|---|---|---|---|
| M-22 | $CH_3$— | 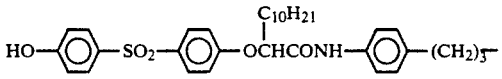 | Cl |
| M-23 | The same as the above | 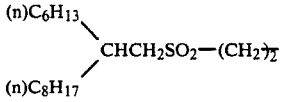 | The same as the above |
| M-24 | 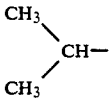 | 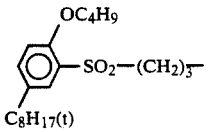 | The same as the above |
| M-25 | 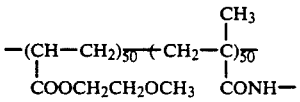 | 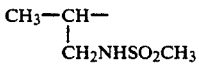 | The same as the above |
| M-26 | 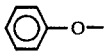 | 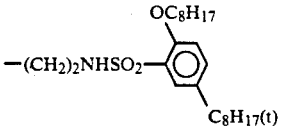 | The same as the above |
| M-27 | $CH_3$— | 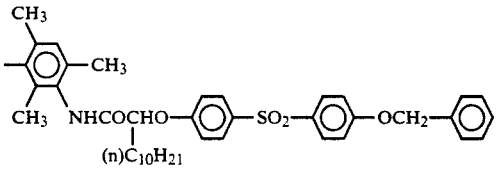 | Cl |
| M-28 | $(CH_3)_3C$— | 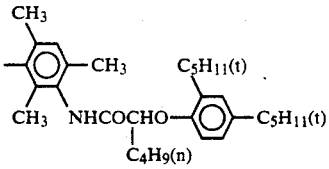 | The same as the above |
| M-29 | 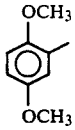 | 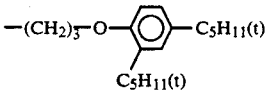 | The same as the above |
| M-30 | $CH_3$— | 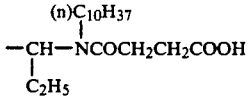 | The same as the above |
(Y-1)
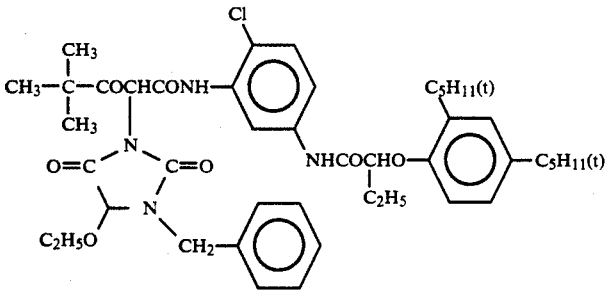

-continued
(Y-2)
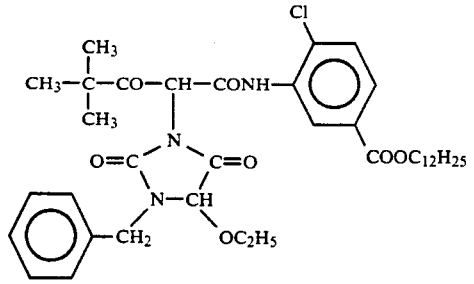
(Y-3)
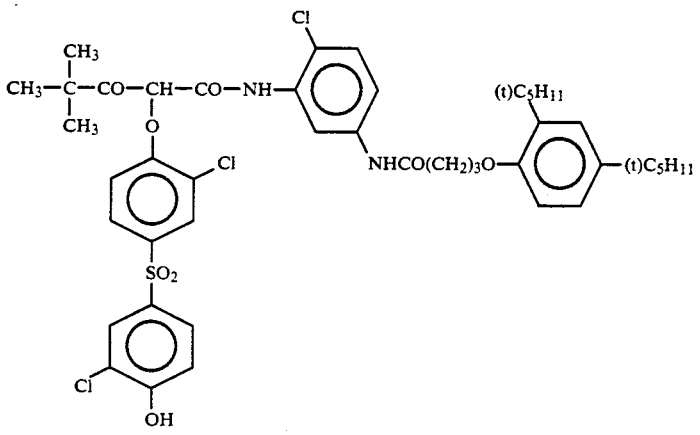
(Y-4)
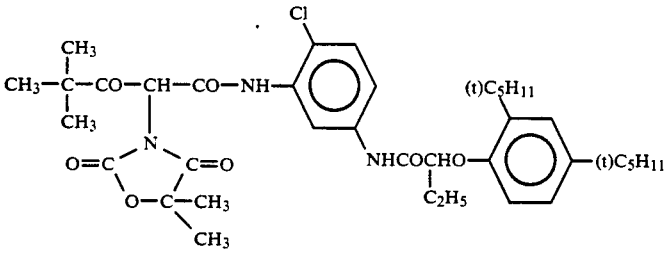
(Y-5)
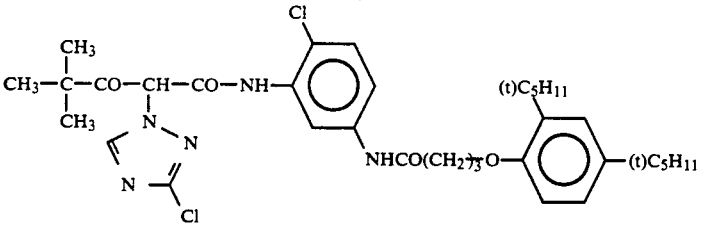
(Y-6)
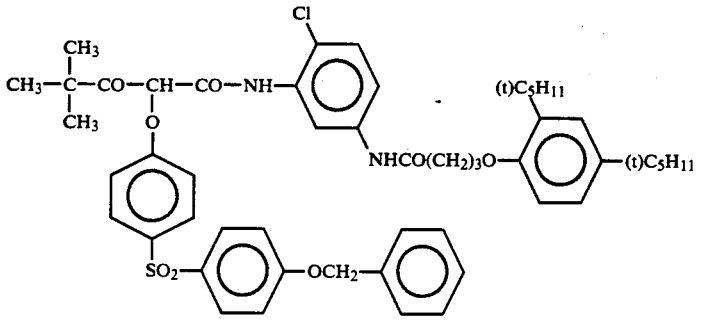

-continued (Y-7)

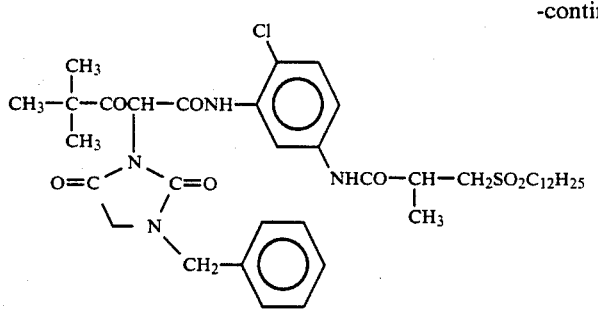

(Y-8)

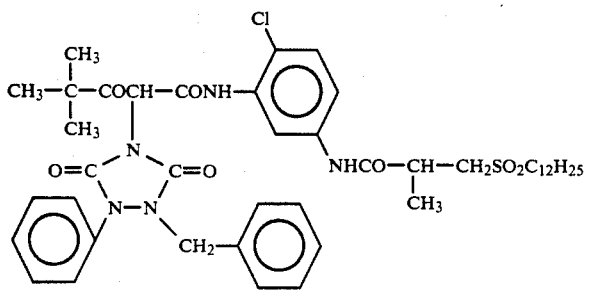

(Y-9)

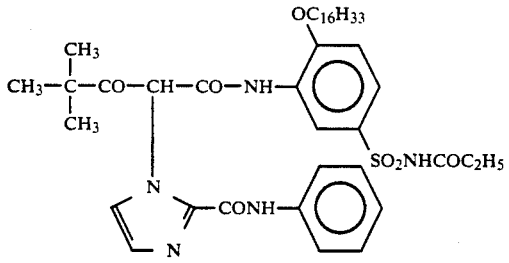

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent used in the present invention, any compound other than compounds represented by formulae ($III_s$) to ($VII_s$) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, another hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt% for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine at the second-order reaction-specific rate $k_2$ (in trioctyl phosphate at 80° C.) in the range of 1.0 l/mol·sec to $1\times10^{-5}$ l/mol·sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{11}-(A_1)_n-X_1 \qquad \text{Formula (FI)}$$

$$R_{12}-\underset{\underset{B_1}{|}}{C}=Y_1 \qquad \text{Formula (FII)}$$

wherein $R_{11}$ and $R_{12}$ each represent an aliphatic group, an aromatic group, or a heterocyclic group, n is 1 or 0, $A_1$ represents a group that will react with an aromatic amine developing agent to form a chemical bond therewith, $X_1$ represents a group that will react with the aromatic amine developing agent and split off, $B_1$ represents a hydrogen atom, an aliphatic group, an aromatic group, a heterocyclic group, an acyl group, or a sulfonyl group, $Y_1$ represents a group that will facilitate the addition of the aromatic amine developing agent to the compound represented by formula (FII), and $R_{11}$ and $X_1$, or $Y_1$ and $R_{12}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{13}-Z \qquad \text{Formula (GI)}$$

wherein $R_{13}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The side opposite to the metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i - R)^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-$\beta$hydroxyethylaniline, 3-methyl-4-amino-N-ethyl-N-$\beta$-methanesulfonamidoethylaniline, and 3-methyl-4-amino-N-ethyl-N-$\beta$-methoxyethylaniline, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggant, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination.

Generally the pH of this color developer and black-and-white developing solution is 9 to 12. The replenishing amount of these developing solutions is generally 3 l or below per square meter of the color photographic material to be processed, though the replenishing amount changes depending on the type of color photographic material. If the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in the processing tank that is in contact with the air. The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $\text{cm}^{-1}$ or less, more preferably 0.001 to 0.05 $\text{cm}^{-1}$.

Methods for reducing the opened surface ratio that can be mentioned include a utilization of movable lids as described in JP-A NO. 241342/1987 and a slit-developing process as described in JP-A No. 216050/1988, besides a method of providing shutting materials such as floating lids.

It is preferable to adopt the means for reducing the opened surface ratio not only in a color developing and black-and-white developing process but also in all succeeding processes, such as bleaching, bleach-fixing, fixing, washing, and stabilizing process.

It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

In practicing the present invention it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ins is $3.0\times10^{-3}$ mol/l or below, and most preferably sulfite ions are not contained at all.

The photographic emulsion layer are generally subjected to a bleaching process after color development.

The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As a typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, but if it is required to quicken the process, the process can be effected at a low pH.

In the bleaching solution, the bleach-fixing solution, and the bath preceding them, a bleach-accelerating agent may be used if necessary. Examples of useful bleach-accelerating agents are compounds having a mercapto group or a disulfide linkage, described in U.S. Pat. No. 95630/1978, and *Research Disclosure* No. 17129 (July, 1978); thiazolidine derivatives, described in JP-A No. 140129/1975; thiourea derivatives, described in U.A. Patent No. 3,706,561; iodide salts, described in JP-A No. 16235/1983; polyoxyethylene compounds in West German Patent No. 2,748,460; polyamine compounds, described in JP-B No. 8836/1970; and bromide ions. Of these, compounds having a mercapto group or a disulfide group are preferable in view of higher acceleration effect, and in particular, compounds described in U.A. Patent No. 3,893,858, West German Patent No.

1,290,812, and JP-A No. 95630/1978 are preferable. Compounds described in U.S. Pat. No. 4,552,834 are preferable. These bleach-accelerating agents may be added into a photographic material. When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, although thiosulfate is used usually, and in particular ammonium thiosulfate is widely used. As the preservative for bleach-fix solution sulfite salt, bisulfite salt, or carbonyl-bisulfite adduct is preferably used.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspended matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku*, (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may very depending, for example, on the characteristics and the application of the photographic material, and they are generally selected in the range of 15° to 45° C. for sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by stabilizing process. As an example thereof can be mentioned a stabilizing bath that is used as a final bath for color photographic materials for photography, which contains formalin and a surface-active agent. In this stabilizing bath, each kind of the chelating agents and bactericides may be added.

The over-flow solution due to the replenishing of washing solution and/or stabilizing solution may be reused in other steps, such as in a desilvering step.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can bu used to improve the image quality or the stability of the processing solution. Also, to save the silver of the photographic material, a process using hydrogen peroxide intensification or cobalt intensification described in West German Patent No. 2,226,770 and U.S. Pat. No. 3,674,499 may be carried out.

According to the present invention, a color photograph wherein yellow is brightly formed, because the yellow color-formed part is substantially free from mixing of magenta, can be obtained.

This effect is particularly remarkable when a pyrazoloazole coupler is used as a magenta coupler and/or processing is carried out using a color developer substantially free from both benzyl alcohol and sulfite ions.

Next, the present invention will be described in detail in accordance with examples, but the invention is not limited to these Examples.

EXAMPLE 1

A multilayer photographic material (101) was prepared by multi-coatings composed of the following layer composition on a two-side polyethylene laminated paper support. Coating solutions were prepared as follows:

Preparation of the First Layer Coating Solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately, another emulsion was prepared by adding two kinds of blue-sensitive sensitizing dye, shown below, to a blend of silver chlorobromide emulsions (cubic grains, 3 : 7 (silver mol ratio) blend of grains having 0.88 μm and 0.7 μm of average grain size, and 0.08 and 0.10 of deviation coefficient of grain size distribution, respectively, each in which 0.2 mol% of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

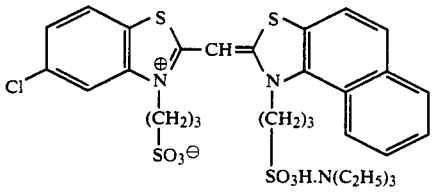

and

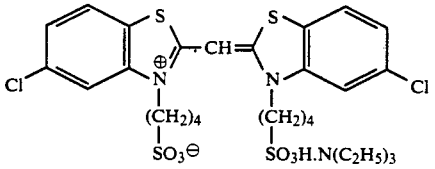

(each $2.0\times10^{-4}$ mol to the large size emulsion and $2.5\times10^{-4}$ mol to the small size emulsion, per mol of silver halide)

Green-Sensitive Emulsion Layer

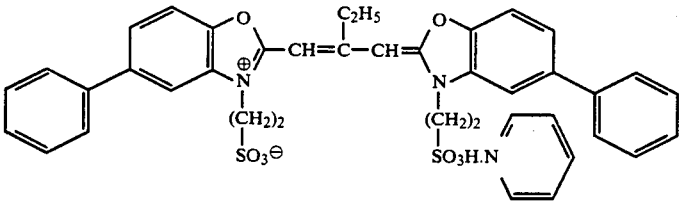

($4.0\times10^{-4}$ mol to the large size emulsion and $5.6\times10^{-4}$ mol to the small size emulsion, per mol of silver halide) and

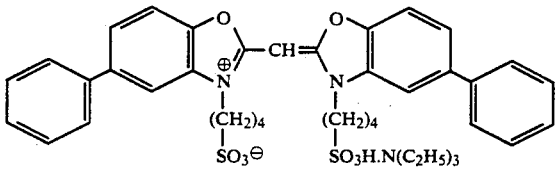

($8.0\times10^{-5}$ mol to the large size emulsion and $1.0\times10^{-5}$ mol to the small size emulsion, per mol of silver halide)

Red-Sensitive Emulsion Layer

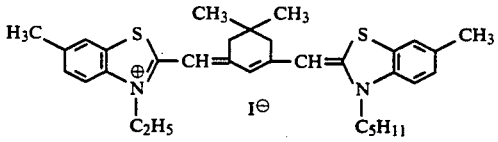

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

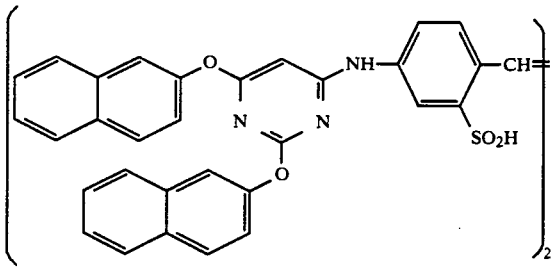

Further, 1-(5-methylureidophenyl)-5-mercapto-tetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, to the blue-sensitive emulsion layer and the green-sensitive layer 4-hydroxy-6-methyl-2,3,3a,7-tetrazaindene was added in amounts of $1\times10^{-4}$ mol and $2\times10^{-4}$ mol per mol of silver halide, respectively.

The following dyes were added to the emulsion were to prevent irradiation.

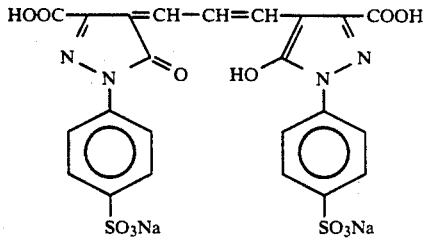

and

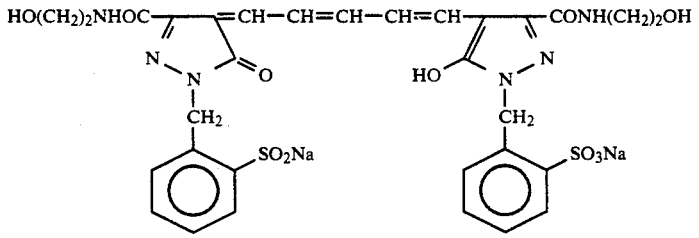

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 2.21 |
| Yellow coupler (ExY) | 1.23 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.40 |
| Color mix inhibitor (Cpd-5) | 0.04 |
| Ultraviolet ray absorber | 0.10 |
| Solvent (Solv-1) | 0.05 |
| Solvent (Solv-3) | 0.05 |
| Solvent (Solv-4) | 0.05 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.04 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Imgae-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |

-continued

| | |
|---|---|
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

R = 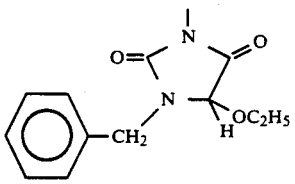 and R = 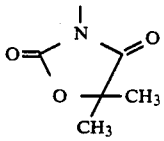

of the following formula

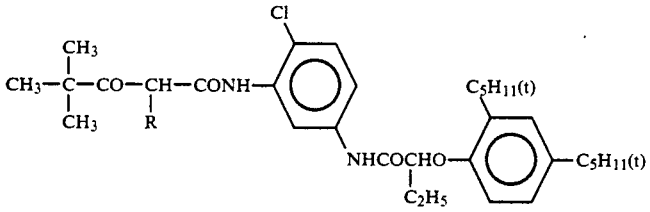

(ExM) Magenta coupler

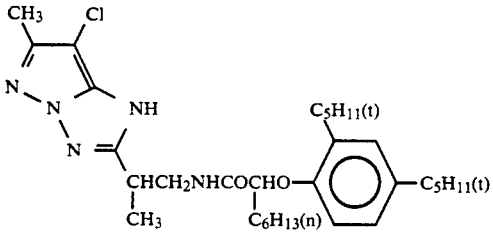

(ExC) Cyan coupler

Mixture (2:4:4 in weight ratio) of

R = $C_2H_5$ and $C_4H_9$ of 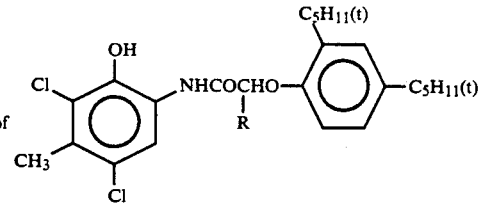

and

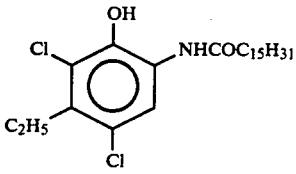

(Cpd-1) Image-dye stabilizer

-continued
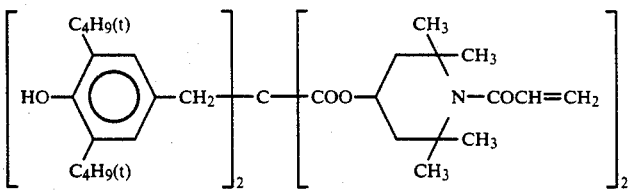
(Cpd-2) Image-dye stabilizer
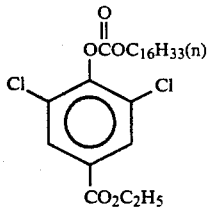
(Cpd-3) Image-dye stabilizer
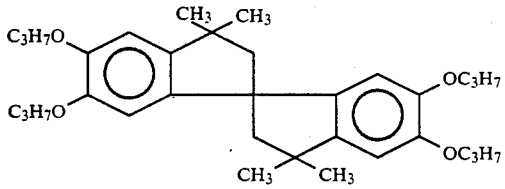
(Cpd-4) Image-dye stabilizer
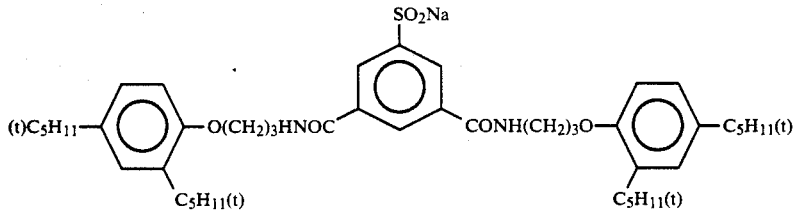
(Cpd-5) Color-mix inhibitor
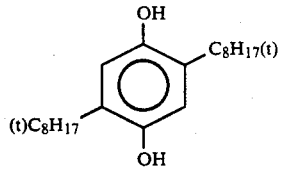
(Cpd-6) Image-dye stabilizer
Mixture (2:4:4 in weight ratio) of
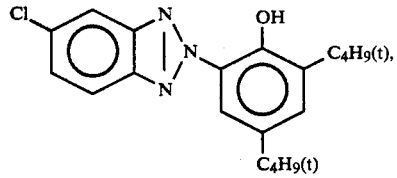
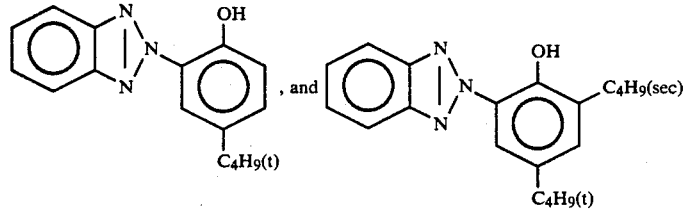

-continued
(Cpd-7) Image-dye stabilizer
$$\left(CH_2-\underset{\underset{CONHC_4H_9(t)}{|}}{CH}\right)_n$$
Average molecular weight: 60,000
(Cpd-9) Image-dye stabilizer
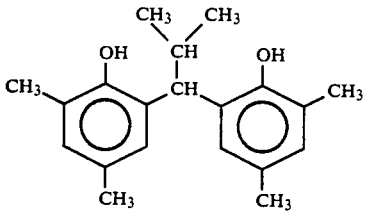
(UV-1) Ultraviolet ray absorber
Mixture (4:2:4 in weight ratio) of
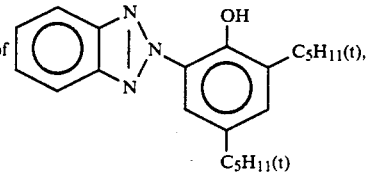
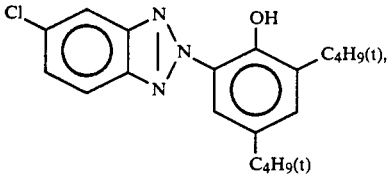
and
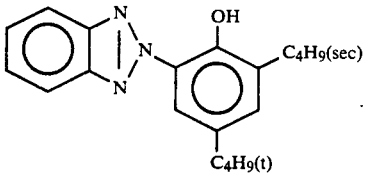
(Solv-1) Solvent
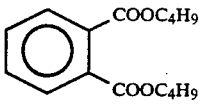
(Solv-2) Solvent
Mixture (2:1 in volume ratio) of
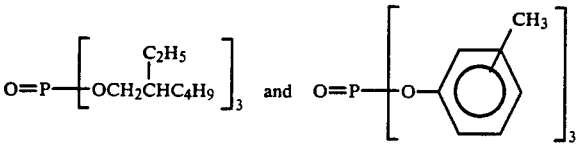
(Solv-3) Solvent
$O{=}P\left[O-C_9H_{19}(iso)\right]_3$
(Solv-4) Solvent -continued

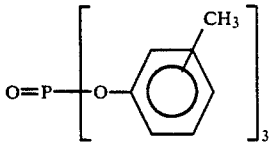

(Solv-5) Solvent

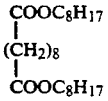

(Solv-6) Solvent

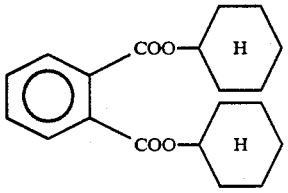

Then, photographic materials (102 to 114) were prepared in the same way as for photographic material (101), except that a color-mixing inhibitor or a sulfinic acid-containing compound is added in the second layer (color mix inhibiting layer) as shown in Table 1.

Then, these photographic papers were given gradation exposure of a three-color separation filter for sensitometry by using a sensitometer (manufactured by Fuji Photo Film Co., Ltd., FWH model, the color temperature of the source of light being 3200 K). The exposure was carried out so that the exposure amount would be 250 CMS with an exposure time of 0.1 sec.

After image-wise exposure of the above Photographic Materials, they were continuously processed (running test) by using a paper processor in the following processing steps until the replenishing amount reached a point twice the amount of the tank volume for color development.

| Processing steps | Temperature | Time | Replenisher Amount* | Tank Volume |
|---|---|---|---|---|
| Color Developing | 35° C. | 45 sec. | 161 ml | 17 l |
| Bleach-fixing | 30–35° C. | 45 sec. | 215 ml | 17 l |
| Rinsing 1 | 30–35° C. | 20 sec. | — | 10 l |
| Rinsing 2 | 30–35° C. | 20 sec. | — | 10 l |
| Rinsing 3 | 30–35° C. | 20 sec. | 50 ml | 10 l |
| Drying | 70–80° C. | 60 sec. | | |

The compositions of each processing solution were as follows:

| | Tank Solution | Replenisher |
|---|---|---|
| Color developer | | |
| Water | 800 ml | 800 ml |
| Ethylenediamine-N,N,N',N'-tetramethylenephosphonic acid | 1.5 g | 2.0 g |

-continued

| | Tank Solution | Replenisher |
|---|---|---|
| Potassium bromide | 0.015 g | — |
| Triethanolamine | 8.0 g | 12.0 g |
| Sodium chloride | 1.4 g | |
| Potassium carbonate | 25 g | 25 g |
| N-ethyl-N-(β-methanesulfonamidoethyl)-3-methyl-4-aminoaniline sulfonate | 5.0 g | 7.0 g |
| N,N-bis(carboxymethyl)hydrazine | 5.5 g | 7.0 g |
| Fluorescent brightening agent (WHITEX-4, made by Sumitomo Chemical Ind. Co.) | 1.0 g | 2.0 g |
| Water to make | 1000 ml | 1000 ml |
| pH (25° C.) | 10.05 | 10.45 |
| Bleach-fixing solution | | |
| (Both tank solution and replenisher) | | |
| Water | 400 ml | |
| Ammonium thiosulfate (56 wt %) | 100 ml | |
| Sodium sulfite | 17 g | |
| Iron (III) ammonium ethylenediaminetetraacetate dihydrate | 55 g | |
| Disodium ethylenediaminetetraacetate | 5 g | |
| Ammonium bromide | 40 g | |
| Water to make | 1000 ml | |
| pH (25° C.) | 5.0 | |
| Rinsing solution | | |
| (Both tank solution and replenisher) | | |
| Ion-exchanged water (Calcium and magnesium each are contained in an amount of 3 ppm or below) | | |

The magenta density at the point where the yellow density of the blue light-exposed part, that is, the yellow color-formed part of the thus processed Samples, was 2.0, was measured to assess the extent of the mixing of colors. The magenta density due to subsidiary absorption of the yellow dye (0.33 in this case) was subtracted from the above measured magenta density, and the difference was assigned as the scale ($\Delta D^G$) of the extent of the mixing of colors. Accordingly, if there is no mixing of colors, $\Delta D^G = 0.00$. The results are indicated in Table 1.

TABLE 1

| Sample | Color-mixing Inhibitor Compound | Color-mixing Inhibitor Coating Amount* | Sulfinic acid-containing Polymer Compound | Sulfinic acid-containing Polymer Coating Amount* | Compound of Formula (II) or (III) Compound | Compound of Formula (II) or (III) Coating Amount* | Degree of Color-mixing ($\Delta D^G$) | Remarks |
|---|---|---|---|---|---|---|---|---|
| 101 | HQ-1 | 0.04 | — | — | — | — | 0.26 | Comparative Example |
| 102 | HQ-1 | 0.10 | — | — | — | — | 0.14 | Comparative Example |
| 103 | — | — | I-1 | 0.04 | — | — | 0.21 | Comparative Example |
| 104 | — | — | I-1 | 0.10 | — | — | 0.11 | Comparative Example |
| 105 | HQ-1 | 0.04 | I-1 | 0.04 | — | — | 0.04 | This Invention |
| 106 | HQ-1 | 0.04 | I-2 | 0.04 | — | — | 0.05 | This Invention |
| 107 | HQ-1 | 0.04 | I-4 | 0.04 | — | — | 0.04 | This Invention |
| 108 | HQ-14 | 0.04 | I-5 | 0.04 | — | — | 0.02 | This Invention |
| 109 | HQ-1 | 0.04 | I-1 | 0.04 | II-9 | 0.02 | 0.00 | This Invention |
| 110 | HQ-1 | 0.04 | I-2 | 0.04 | II-26 | 0.02 | 0.01 | This Invention |
| 111 | HQ-1 | 0.04 | I-1 | 0.04 | II-35 | 0.02 | 0.00 | This Invention |
| 112 | HQ-9 | 0.04 | I-4 | 0.04 | II-35 | 0.04 | 0.00 | This Invention |
| 113 | HQ-15 | 0.04 | I-1 | 0.02 | III-9 | 0.02 | 0.00 | This Invention |
| 114 | RD-7 | 0.04 | I-1 | 0.02 | III-14 | 0.02 | 0.00 | This Invention |

Note: *(g/m$^2$)

From the results shown in Table 1, it can be understood that in the cases of Comparative Samples 101 to 104, wherein only a color-mixing inhibitor or a sulfinic acid-containing polymer is added, if they are increased alone, magenta is mixed in the yellow color-formed part and there is a little effect of lowering color contamination, whereas in the cases of Samples 105 to 114, according to the present invention, there is substantially no mixing of colors, bright yellow is formed, and they are excellent in color reproduction, because there is no harmful subsidiary absorption near 450 nm.

Further, samples 115 to 119 were prepared in the manner as sample 101, except that above described magenta coupler M-4 was used in stead of magenta coupler (ExM), and the same evaluation was effected. Results are shown in Table 2. The effect of color-mixing inhibition of the present invention was confirmed.

TABLE 2

| Sample | Color-mixing Inhibitor Compound | Color-mixing Inhibitor Coating Amount* | Sulfinic acid-containing Polymer Compound | Sulfinic acid-containing Polymer Coating Amount* | Compound of Formula (II) or (III) Compound | Compound of Formula (II) or (III) Coating Amount* | Degree of Color-mixing ($\Delta D^G$) | Remarks |
|---|---|---|---|---|---|---|---|---|
| 115 | HQ-1 | 0.04 | — | — | — | — | 0.07 | Comparative Example |
| 116 | — | — | I-1 | 0.04 | — | — | 0.05 | Comparative Example |
| 117 | HQ-1 | 0.04 | I-1 | 0.04 | — | — | 0.04 | This Invention |
| 118 | HQ-14 | 0.04 | I-1 | 0.04 | II-9 | 0.02 | 0.01 | This Invention |
| 119 | HQ-15 | 0.04 | I-4 | 0.04 | III-14 | 0.02 | 0.00 | This Invention |

Note: *(g/m$^2$)

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material which comprises on a base at least one silver halide emulsion layer containing at least one coupler that can form a dye by the coupling reaction with the oxidized product of an aromatic primary amine developing agent and silver chloride or silver chlorobromide comprising 90 mol% or more silver chloride and that is substantially free from silver iodide, and at least one non-photosensitive layer containing at least one oil-soluble color-mixing inhibitor that can undergo redox reaction with the oxidized product of said developing agent, and at least one homopolymer or copolymer having repeating units represented by the following formula (I):

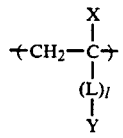

Formula (I)

wherein X represents a hydrogen atom or a lower alkyl group or an aralkyl group, L represents a bivalent linking group, Y represents a sulfinic acid group or a sulfinic acid group forming a salt, and l represents 0 or 1.

2. The silver halide color photographic material as claimed in claim 1, wherein the non-photosensitive layer further contains at least one of substantially non-diffusible oil-soluble compounds represented by the following formulae (II) and (III):

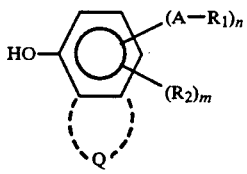

Formula (II)

wherein A represents a bivalent electron-attractive group, $R_1$ represents an aliphatic group, an aryl group, an alkoxy group, an aryloxy group, an alkylamino group, an anilino group, a heterocyclic amino group, or a heterocyclic group, n is 1 or 2, $R_2$ represents an aliphatic group, an alkoxy group, a hydroxyl group, or halogen, m is an integer of 0 to 4, and to the phenol ring may be fused a benzene ring or a heterocyclic group formed at Q, $HO-R_3$ Formula (III)

wherein $R_3$ represents an aliphatic group having 12 or more carbon atoms in all.

3. The silver halide color photographic material as claimed in claims 1, wherein the coupler is a pyrazoloazole coupler.

4. The silver halide color photographic material as claimed in claims 1, wherein X in formula (I) represents a hydrogen atom or a methyl group.

5. The silver halide color photographic material as claimed in claims 1, wherein L in formula (I) is selected from the group consisting of

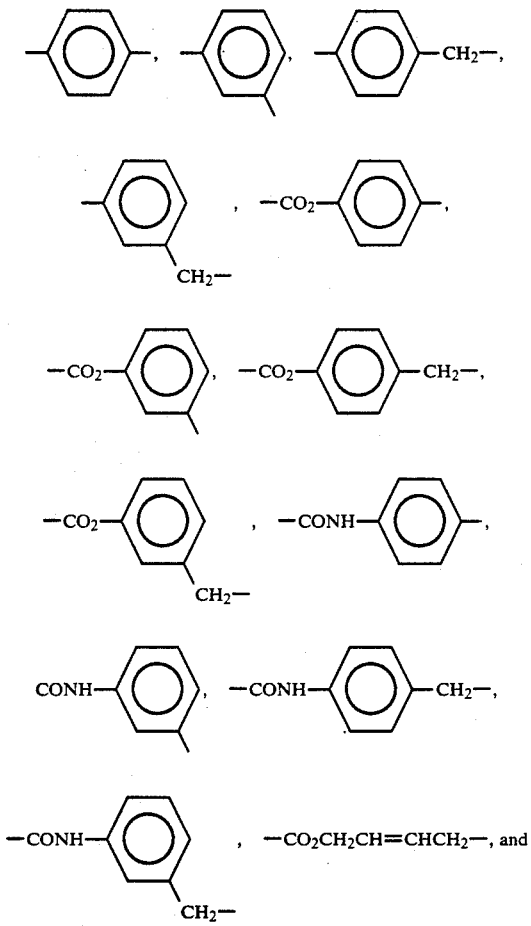

6. The silver halide color photographic material as claimed in claims 1, wherein Y in formula (I) represents a sulfinic acid group forming a base with a monovalent to trivalent cation.

7. The silver halide color photographic material as claimed in claims 1, wherein the sulfinic acid-containing polymer represented by formula (I) is synthesized by using two or more ethylenically unsaturated monomers having at least one sulfinic acid group.

8. The silver halide color photographic material as claimed in claims 1, wherein the sulfinic acid-containing polymer represented by formula (I) is synthesized by using an ethylenically unsaturated monomer having a sulfinic acid group and an ethylenically unsaturated monomer having no sulfinic acid group.

9. The silver halide color photographic material as claimed in claims 1, wherein the molecular weight of sulfinic acid-containing polymer represented by formula (I) is in the range of 5,000 to 1,000,000.

10. The silver halide color photographic material as claimed in claims 1, wherein the amount of the sulfinic acid-containing compound represented by formula (I) is used 5 to 300 mg/m$^2$ in one of non-photosensitive layer of the silver halide color photographic material.

11. The silver halide color photographic material as claimed in claims 2, wherein A in formula (II) represents a bivalent electron attractive group represented by

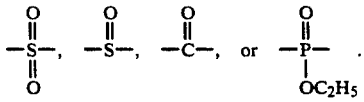

12. The silver halide color photographic material as claimed in claims 2, wherein the total carbon number of the oil-soluble compound represented by formula (II) is 10 or more.

13. The silver halide color photographic material as claimed in claim 2, wherein the at least one non-photosensitive layer further comprises a color mixing inhibition promoter, wherein the weight ratio of the color mixing inhibition promoter to the color mixing inhibitor is in a range of 0.05 to 2.

14. The silver halide color photographic material as claimed in claims 1, wherein the color-mixing inhibitor is used in an amount of 7 to 400 mg/m$^2$ of the silver halide color photographic material.

15. The silver halide color photographic material as claimed in claims 1, wherein the color-mixing inhibitor is selected from the group consisting of alkylhydroquinones represented by the following formula (HQ-1), hydroquinone sulfonates represented by the following formula (HQ-2), and amidohydroquinones represented by the following formula (RD-1):

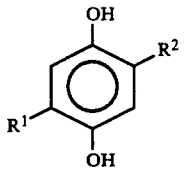

Formula (HQ-1)

wherein $R^1$ and $R^2$ each represent a hydrogen atom or a substituted or unsubstituted alkyl group having 1 to carbon atoms, and one of $R^1$ and $R^2$ is an alkyl group, Formula (HQ-2)

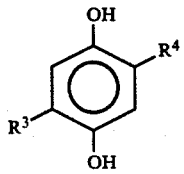

Formula (HQ-2)

wherein $R^3$ represents a substituted or unsubstituted alkyl, alkylthio, amido, or alkyloxy group, and $R^4$ represents a sulfo group or a sulfoalkyl group

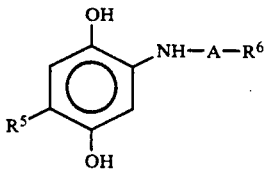

Formula (RD-1)

wherein $R^5$ represents a hydrogen atom, a halogen atom, or a substituted or unsubstituted alkyl group, A represents

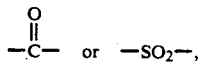

and $R^6$ represents a substituted or unsubstituted alkyl or aryl group.

16. The silver halide color photographic material as claimed in claims 2, wherein a high-boiling solvent represented by the following formula ($III_s$), ($IV_s$), ($V_s$), ($VI_s$), ($VII_s$) is used for preparing dispersion of oil-soluble substances:

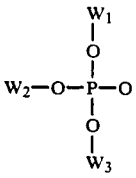

Formula ($III_s$)

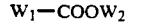

Formula ($IV_s$)

-continued

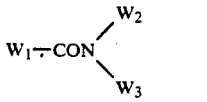

Formula ($V_s$)

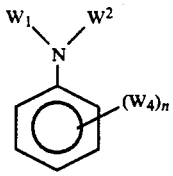

Formula ($VI_s$)

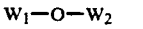

Formula ($VII_s$)

wherein $W_1$, $W_2$, and $W_3$ each represent a substituted or unsubstituted, alkyl group, cycloalkyl group, alkenyl group, aryl group, or heterocyclic group, $W_4$ represents $W_1$, O-$W_1$ or S-$W_1$, n is an integer of 1 to 5, when n is 2 or over, $W_4$ groups may be the same or different, and in formula ($VII_s$), $W_1$ and $W_2$ may together form a condensed ring.

17. A color-image-forming method, which comprises after exposing silver halide color photographic material as claimed in claim 1 to light image-wise, subjecting the silver halide photographic material to color-development with a color developer substantially free from benzyl alcohol.

18. The silver halide color photographic material as claimed in claim 15, wherein the alkyl groups are selected from the group consisting of methyl, t-butyl, n-octyl, sec-octyl, t-octyl, sec-dodecyl, t-pentadecyl and sec-octadecyl.

19. The silver halide color photographic material as claimed in claim 15, wherein the sulfoalkyl group is sulfopropyl.

* * * * *